US008722291B2

(12) United States Patent
Sugitate et al.

(10) Patent No.: US 8,722,291 B2
(45) Date of Patent: May 13, 2014

(54) ELECTROSTATIC CHARGE IMAGE DEVELOPER, PROCESS CARTRIDGE, IMAGE FORMING APPARATUS, AND IMAGE FORMING METHOD

(75) Inventors: Atsushi Sugitate, Kanagawa (JP); Masaru Takahashi, Kanagawa (JP); Shotaro Takahashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/532,231

(22) Filed: Jun. 25, 2012

(65) Prior Publication Data

US 2013/0252155 A1 Sep. 26, 2013

(30) Foreign Application Priority Data

Mar. 26, 2012 (JP) ..... 2012-070216

(51) Int. Cl.
*G03G 9/00* (2006.01)
*G03G 15/08* (2006.01)

(52) U.S. Cl.
USPC ..... 430/108.1; 430/105; 430/109.1; 430/110.1; 430/118.8; 430/123.5; 399/111; 399/252

(58) Field of Classification Search
USPC ..... 430/110.4, 118.8, 123.41, 125.3, 108.1, 430/105, 109.1, 123.5; 399/252, 111
See application file for complete search history.

(56) References Cited

U.S. PATENT DOCUMENTS 4,976,777 A 12/1990 Ozawa et al.
5,062,886 A 11/1991 Ozawa et al.
5,198,320 A 3/1993 Vreeland et al.
5,480,481 A 1/1996 Setoguchi et al.
5,482,808 A 1/1996 Kondo et al.
5,753,392 A 5/1998 Ray et al.
5,910,388 A 6/1999 Ray et al.
6,017,670 A * 1/2000 Hashizume et al. ..... 430/109.2
6,245,140 B1 6/2001 Monden et al.
6,281,277 B1 8/2001 Ishii et al.
7,267,920 B2 9/2007 Nakazawa et al.
7,413,841 B2 8/2008 Yuasa
2002/0192585 A1 12/2002 Brenner et al.
2006/0093937 A1 5/2006 Grinwald
2007/0059626 A1 3/2007 Inoue et al.

(Continued)

FOREIGN PATENT DOCUMENTS

EP 2 047 335 B1 5/2011
JP A-62-67558 3/1987

(Continued)

OTHER PUBLICATIONS

U.S. Appl. No. 12/943,630, filed Nov. 10, 2010, first named inventor Yasuo Kadokura.

(Continued)

*Primary Examiner* — Thorl Chea
(74) *Attorney, Agent, or Firm* — Oliff PLC

(57) ABSTRACT

Provided is an electrostatic charge image developer including a first toner that contains a binder resin and a brilliant pigment, a second toner that contains a binder resin without a brilliant pigment, and a carrier, wherein the developer satisfies the following formulae, $5\ \mu m \leq A \leq 30\ \mu m$ (1):

$1\ \mu m \leq B \leq 15\ \mu m$ (2):

$3.0 \leq C/A \leq 5.0$ (3):

$5.0 \leq C/B \leq 20.0$ (4):

wherein A represents a volume average particle size of the first toner, B represents a volume average particle size of the second toner, and C represents a volume average particle size of the carrier.

18 Claims, 3 Drawing Sheets

(56) References Cited

U.S. PATENT DOCUMENTS

| | | | | |
|---|---|---|---|---|
| 2007/0072103 | A1 | 3/2007 | Kawamura et al. | |
| 2007/0207397 | A1 | 9/2007 | Julien | |
| 2008/0118280 | A1 | 5/2008 | Han et al. | |
| 2008/0182198 | A1 | 7/2008 | Kawamura et al. | |
| 2008/0193868 | A1 | 8/2008 | Schuster et al. | |
| 2008/0277490 | A1 | 11/2008 | Kinoshita et al. | |
| 2009/0029278 | A1 | 1/2009 | Op De Beeck et al. | |
| 2009/0103950 | A1 | 4/2009 | Nakayama et al. | |
| 2009/0111040 | A1 | 4/2009 | Veregin et al. | |
| 2009/0288580 | A1 | 11/2009 | Cai | |
| 2010/0183964 | A1* | 7/2010 | Yoshida et al. | 430/107.1 |
| 2010/0330487 | A1 | 12/2010 | Veregin et al. | |
| 2011/0262654 | A1 | 10/2011 | Yates et al. | |
| 2011/0262858 | A1 | 10/2011 | Nair et al. | |
| 2011/0318682 | A1 | 12/2011 | Takahashi et al. | |
| 2011/0318683 | A1 | 12/2011 | Kadokura et al. | |
| 2013/0078562 | A1* | 3/2013 | Takahashi et al. | 430/105 |

FOREIGN PATENT DOCUMENTS

| | | |
|---|---|---|
| JP | A-62-100769 | 5/1987 |
| JP | A-02-073872 | 3/1990 |
| JP | A-6-57171 | 3/1994 |
| JP | A-09-106094 | 4/1997 |
| JP | A-9-302257 | 11/1997 |
| JP | A-10-324505 | 12/1998 |
| JP | A-2000-7941 | 1/2000 |
| JP | A-2000-221780 | 8/2000 |
| JP | A-2003-29444 | 1/2003 |
| JP | A-2003-213157 | 7/2003 |
| JP | A-2006-039475 | 2/2006 |
| JP | A-2010-072334 | 4/2010 |
| JP | A-2010-256613 | 11/2010 |
| WO | WO 2006/041658 | 4/2006 |
| WO | WO 2009/026360 A2 | 2/2009 |

OTHER PUBLICATIONS

Oct. 11, 2012 Office Action issued in U.S. Appl. No. 12/943,630.
Diamond et al., "Handbook of Imaging Material," Second Edition, Marcel Dekker, Inc., (2002), pp. 145-164, NY, USA.
Aug. 7, 2013 Office Action issued in U.S. Appl. No. 12/943,630.
Tony Whelan, Polymer Technology Dictionary, 1993, p. 256, Chapman & Hall, London, UK.
Apr. 11, 2013 Office Action issued in U.S. Appl. No. 12/943,630.
May 16, 2013 Office Action issued in U.S. Appl. No. 12/955,302.
Dec. 17, 2012 Office Action issued in U.S. Appl. No. 12/907,313.
Jan. 23, 2013 Office Action issued in U.S. Appl. No. 12/955,302.
U.S. Appl. No. 12/907,313 to Takahashi et al., filed Oct. 19, 2010.
U.S. Appl. No. 12/955,302 to Takahashi et al. filed Nov. 29, 2010.
Nov. 23, 2012 Office Action issued in Australian Patent Application No. 2012200768, pp. 1-4.
Oct. 11, 2013 Notice of Allowance issued in U.S. Appl. No. 12/955,302.
Jun. 21, 2013 Office Action issued in U.S. Appl. No. 13/364,095.
Oct. 1, 2013 Office Action issued in U.S. Appl. No. 13/564,256.
Aug. 14, 2013 Office Action issued in U.S. Appl. No. 13/454,597.
Nov. 13, 2013 Office Action issued in U.S. Appl. No. 13/469,642.
Briggs et al., "The Effects of Fusing on Gloss in Electrophotography," IS&T's NIP14 International Conference on Digital Printing Technologies, Oct. 18-23, 1998, Toronto, Ontario, Canada.
Pettersson et al. "Leveling During Toner Fusing: Effects on Surface Roughness and Gloss of Printed Paper," Journal of Imaging Science and Technology 50 (2), pp. 202-215, 2006.
Nov. 22, 2013 Office Action issued in U.S. Appl. No. 12/943,630.
U.S. Appl. No. 13/454,597 to Nakashima et al., filed Apr. 24, 2012.
U.S. Appl. No. 13/469,642 to Sato et al., filed May 11, 2012.
U.S. Appl. No. 13/564,256 Sato et al., filed Aug. 1, 2012.
U.S. Appl. No. 13/364,095 Takahashi et al., filed Feb. 1, 2012.
Dec. 4, 2013 Office Action issued in U.S. Appl. No. 13/364,095.
Dec. 19, 2013 Office Action issued in U.S. Appl. No. 13/454,597.

* cited by examiner

ELECTROSTATIC CHARGE IMAGE DEVELOPER, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2012-070216 filed Mar. 26, 2012.

BACKGROUND

1. Technical Field

The present invention relates to an electrostatic charge image developer, a process cartridge, an image forming apparatus, and an image forming method.

2. Related Art

In an electrophotography method, an image is generally formed through plural steps including electrically forming a latent image by various methods on the surface of a photoreceptor (an electrostatic latent image holding member) that uses a photoconductive material, developing the formed latent image by using a developer that contains a toner so as to form a developed image, subsequently transferring the developed image to a recording medium such as paper optionally via an intermediate transfer member, and fixing the image by heating, pressurizing, heating with pressurizing, and the like.

As developers used for forming images in the above manner, those containing a toner that contains a brilliant pigment are known. With the use of the developer, images having brilliance similar to metal glossiness may be formed.

SUMMARY

That is, according to an aspect of the invention, there is provided an electrostatic charge image developer including a first toner that contains a binder resin and a brilliant pigment, a second toner that contains a binder resin without a brilliant pigment, and a carrier, wherein the developer satisfies the following formulae, $$5\ \mu m \le A \le 30\ \mu m \quad (1):$$

$$1\ \mu m \le B \le 15\ \mu m \quad (2):$$

$$3.0 \le C/A \le 5.0 \quad (3):$$

$$5.0 \le C/B \le 20.0, \quad (4):$$

wherein A represents a volume average particle size of the first toner, B represents a volume average particle size of the second toner, and C represents a volume average particle size of the carrier.

BRIEF DESCRIPTION OF THE DRAWINGS

Exemplary embodiments of the present invention will be described in detail based on the following figures, wherein.

DETAILED DESCRIPTION

Figure 1:
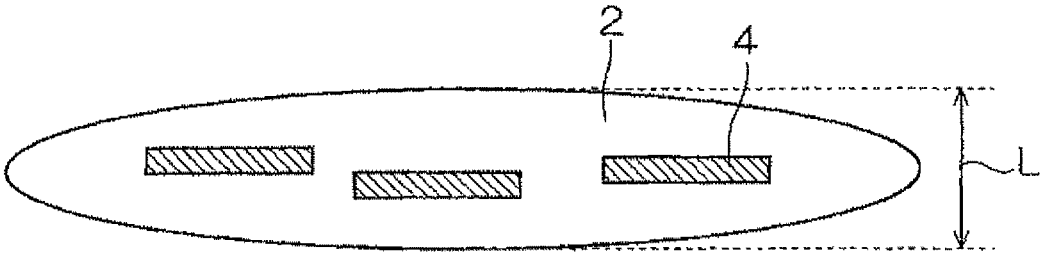
FIG. 1 is a cross-sectional view schematically showing an example of a toner particle containing a brilliant pigment in the developer according to the present exemplary embodiment.

Hereinbelow, exemplary embodiments of the developer, the process cartridge, and the image forming apparatus according to the present invention will be described in detail.

Developer

The developer according to the present exemplary embodiment contains a first toner that has a volume average particle size represented by A and contains a binder resin and a brilliant pigment, a second toner that has a volume average particle size represented by B and contains a binder resin but does not contain a brilliant pigment, and a carrier that has a volume average particle size represented by C, wherein the respective volume average particle sizes represented by A, B, and C satisfy all of the following conditions (1) to (4).

$$5\ \mu m \le A \le 30\ \mu m \quad (1):$$

$$1\ \mu m \le B \le 15\ \mu m \quad (2):$$

$$3.0 \le C/A \le 5.0 \quad (3):$$

$$5.0 \le C/B \le 20.0 \quad (4):$$

In addition, the respective volume average particle sizes represented by A, B, and C preferably satisfy all of the following conditions (5) to (8).

$$10\ \mu m \le A \le 20\ \mu m \quad (5):$$

$$5\ \mu m \le B \le 10\ \mu m \quad (6):$$

$$3.5 \le C/A \le 4.5 \quad (7):$$

$$7.0 \le C/B \le 12.0 \quad (8):$$

The developer according to the present exemplary embodiment having the above constitution has an effect that excellently reproduces fine lines while maintaining brilliance of an image.

Though unclear, the reason is assumed to be as below.

In the toner containing a brilliant pigment, the brilliant pigment itself has a large diameter and a flake shape (disc shape). Consequently, the shape of the toner particles is also flat. On the other hand, many of the toner particles of the toner not containing the brilliant pigment are approximately spherical even though the shape may depend on the preparation method thereof.

When the toners containing and not containing the brilliant pigment are simply mixed in the toner constituting the developer, the difference in the shape of the respective toner particles described above, the relationship between toner particles and external additives, and the relationship between the diameter of the toner and the diameter of the carrier cause selectivity in the ease of developing and the ease of transfer. As a result, brilliance of an image deteriorates, or the efficiency of transfer from the carrier to the toner is decreased, which makes it difficult to obtain fine line reproducibility when the developer is applied to image formation.

Contrary to this, in the developer according to the present exemplary embodiment, not only are the toners containing and not containing the brilliant pigment mixed, but also the volume average particle sizes (conditions of (1) and (2)) of these toners are specified. Furthermore, the relationship (conditions of (3) and (4)) between the volume average particle sizes of these toners and the volume average particle size of the carrier is specified.

It is considered that by satisfying all of the specific conditions, a state where a (flake-shape) toner containing the brilliant pigment contacts the surface of the carrier in an appropriate contact area may be created, by causing the developer to contain the toner that contains the brilliant pigment and has a relatively large particle size and the toner that does not contain the brilliant pigment and has an appropriate size.

Consequently, presumably, the brilliance of an image may be sufficiently obtained, and excellent fine line reproducibility may be achieved by, for example, inhibiting the external additive from being embedded in the toner particles due to the carrier, inhibiting the carrier from moving to a toner image, and preventing the decrease in the efficiency of transfer from the carrier to the toner.

Hereinbelow, (a) a toner containing a brilliant pigment (first toner), (b) a toner not containing a brilliant pigment (second toner), and (c) a carrier which constitute the developer according to the present exemplary embodiment will be described in order.

In the present exemplary embodiment, a "toner" refers to a combination which includes toner particles containing a binder resin and optionally resin particles that contain colorants such as a brilliant pigment and a release agent, and optionally includes external additives externally added to the toner particles.

(a) Toner Containing Brilliant Pigment (First Toner)

In the present exemplary embodiment, the (a) toner containing a brilliant pigment has a volume average particle size represented by A.

As described above, A needs to satisfy (1): 5 μm≤A≤30 μm (preferably (5): 10 μm≤A≤20 μm). That is, the volume average particle size of the (a) toner containing a brilliant pigment is from 5 μm to 30 μm, and preferably from 10 μm to 20 μm.

When the volume average particle size of the (a) toner containing a brilliant pigment is smaller than 5 μm, the particle size of the brilliant pigment is small, and the content of this pigment becomes small, so brilliance is reduced in some cases.

When the volume average particle size of the (a) toner containing a brilliant pigment is larger than 30 μm, the particle size becomes too large, so fine line reproducibility deteriorates in some cases when an image is formed.

The volume average particle size of the (a) toner containing a brilliant pigment refers to the particle size in a state not containing the external additive, that is, the size of toner particles. The volume average particle size is measured in the following manner.

The volume average particle size $D_{50}$ is calculated in the following manner.

Within particle size ranges (channels) divided based on a particle size distribution that is measured by a measurement instrument such as a Multisizer-II (manufactured by Beckman Coulter, Inc.), a cumulative distribution of the volume and number of particles is respectively created from small-sized particles. A particle size of cumulative 16% is defined as a volume $D_{16v}$ and a number $D_{16p}$, a particle size of cumulative 50% is defined as a volume $D_{50v}$ and a number $D_{50p}$, and a particle size of cumulative 84% is defined as a volume $D_{84v}$ and a number $D_{84p}$.

Among the above, the volume $D_{50v}$ is taken as the volume average particle size $D_{50}$.

When the external additive is removed from the toner that had previously contained the externally added additive so as to measure the volume average particle size of the toner particles in this state, 1 g of the toner is dispersed in a surfactant, and the resultant is dispersed using an ultrasonic dispersing apparatus (RUS-600TCVP, manufactured by NISSEI Corporation) to remove the external additive.

Next, components constituting the (a) toner containing a brilliant pigment, that is, a brilliant pigment, a binder resin, and the like will be described.

Brilliant Pigment

The (a) toner containing a brilliant pigment contains a brilliant pigment as a colorant.

Examples of the brilliant pigment in the present exemplary embodiment include metal powders such as aluminum, brass, bronze, nickel, stainless steel, and zinc; mica coated with titanium oxide or yellow iron oxide; flake-like coated inorganic crystalline substrates such as barium sulfate, a laminar silicate salt, and a silicate salt of laminar aluminum; monocrystalline plate-like titanium oxide; a basic carbonate salt; acid bismuth oxychloride; natural guanine; flake-like glass powder; metal-deposited flake-like glass powder; and the like. The brilliant pigment is not particularly limited as long as the pigment has brilliance.

Commercially available products may also be used as the brilliant pigment, and examples thereof include an aluminum pigment (2173EA manufactured by SHOWA ALUMINUM POWDER K.K) and the like.

The term "brilliance" in the present exemplary embodiment indicates a property in which brilliance similar to metal glossiness is perceived when an image formed using the toner containing a brilliant pigment is visually observed.

The content of the brilliant pigment used in the (a) toner containing a brilliant pigment is preferably from 1 part by weight to 30 parts by weight, and more preferably from 5 parts by weight to 25 parts by weight, based on 100 parts by weight of the toner particles. When the content is equal to or more than 1 part by weight, an image with an excellent impression of brilliance may be obtained. When the content is equal to or less than 30 parts by weight, since deterioration of developing property and transfer properties caused by the decrease in electric resistance of the toner may be inhibited, an image with an excellent impression of brilliance may be obtained.

Binder Resin

The (a) toner containing a brilliant pigment contains a binder resin for coating the brilliant pigment described above.

It is preferable that the brilliant pigment be coated with the binder resin such that the surface of the brilliant pigment is not exposed from the coating layer of the binder resin, in view of not decreasing electric resistance of the toner so as not to cause uneven transfer.

Examples of the binder resin constituting the (a) toner containing a brilliant pigment include ethylene-based resins such as polyester, polyethylene, and polypropylene; styrene-based resins such as polystyrene and α-polymethylstyrene; (meth)acrylic resins such as polymethyl methacrylate and polyacrylonitrile; polyamide resins; polycarbonate resins; polyether resins; and copolymer resins of these. It is preferable to use a polyester resin among these.

Hereinbelow, the polyester resin particularly preferably used will be described.

The polyester resin is mainly obtained by, for example, condensation polymerization of polyvalent carboxylic acids and polyols.

Examples of the polyvalent carboxylic acid include aromatic carboxylic acids such as terephthalic acid, isophthalic acid, phthalic anhydride, trimellitic anhydride, pyromellitic acid, and naphthalene dicarboxylic acid; aliphatic carboxylic acids such as maleic anhydride, fumaric acid, succinic acid, alkenyl succinic anhydrides, and adipic acid; and alicyclic carboxylic acids such as cyclohexane dicarboxylic acid. One or two or more kinds of these polyvalent carboxylic acids may be used.

Among these polyvalent carboxylic acids, it is preferable to use an aromatic carboxylic acid. In addition, in order to form a crosslinked structure or a branched structure so as to secure excellent fixing properties, it is preferable to use a dicarboxylic acid concurrently with a carboxylic acid (trimellitic acid or an acid anhydride thereof, for example) having a valency of equal to or higher than 3.

Examples of the polyol include aliphatic diols such as ethylene glycol, diethylene glycol, triethylene glycol, propylene glycol, butanediol, hexanediol, neopentyl glycol, and glycerin; alicyclic diols such as cyclohexanediol, cyclohexanedimethanol, and hydrogenated bisphenol A; and aromatic dials such as an ethylene oxide adducts of bisphenol A and propylene oxide adducts of bisphenol A. One or two or more kinds of these polyols may be used.

Among these polyols, aromatic dials and alicyclic dials are preferable, and aromatic diols are more preferable. In addition, in order to form a crosslinked structure or a branched structure so as to secure excellent fixing properties, it is also preferable to use the diol concurrently with a polyol (glycerin, trimethylolpropane, or pentaerythritol) having a valency of equal to or higher than 3.

The (a) toner containing a brilliant pigment preferably contains a crystalline polyester resin as a binder resin. Among crystalline polyester resins, many aromatic crystalline resins generally have a melting temperature higher than the melting temperature range described later. Accordingly, the crystalline polyester resin is preferably an aliphatic crystalline polyester resin.

The content of the crystalline polyester resin in the toner particles of the (a) toner containing a brilliant pigment is preferably from 2% by weight to 30% by weight, and more preferably from 4% by weight to 25% by weight.

The melting temperature of the crystalline polyester resin preferably ranges from 50° C. to 100° C., more preferably ranges from 55° C. to 95° C., and even more preferably ranges from 60° C. to 90° C.

The "crystalline polyester resin" of the present exemplary embodiment refers to a polyester resin that does not show stepwise change in endothermic amount but has a clear endothermic peak in Differential Scanning Calorimetry (hereinbelow, abbreviated to "DSC" in some cases). In addition, when the crystalline polyester resin is a polymer that is obtained by copolymerizing the main chain of this resin with other components, if the amount of other components is equal to or less than 50% by weight, this copolymer is also called a crystalline polyester.

The crystalline polyester resin is synthesized from an acid (carboxylic acid) component and an alcohol (diol) component. In the following description, an "acid-derived constituent component" refers to a constitutional moiety in a polyester resin, which is a moiety that is an acid component before the synthesis of the polyester resin, and an "alcohol-derived constituent component" refers to a constitutional moiety that is an alcohol component before the synthesis of the polyester resin.

Acid-Derived Constituent Component

Examples of acids to be the acid-derived constituent component include various dicarboxylic acids. However, as the acid-derived constituent component in the crystalline polyester resin of the present exemplary embodiment, linear aliphatic dicarboxylic acids are preferable.

Examples of the acids include, but are not limited to, oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, and lower alkyl esters or acid anhydrides of these. Among these, adipic acid, sebacic acid, and 1,10-decanedicarboxylic acid are preferable.

As the acid-derived constituent component, constituent components other than the above ones, such as a constituent component derived from a dicarboxylic acid having a double bond and a constituent component derived from a dicarboxylic acid having a sulfonic acid group, may be contained.

Examples of the dicarboxylic acid having a sulfonic acid group include, but are not limited to, a sodium 2-sulfoterephthalate salt, a sodium 5-sulfoisophthalate salt, a sodium sulfosuccinate salt, and the like. The examples also include lower alkyl esters and acid anhydrides of these. Among these, sodium 5-sulfoisophthalate salt and the like are preferable.

In the acid-derived constituent component, the content of acid-derived constituent components (a constituent component derived from a dicarboxylic acid having a double bond and a constituent component derived from a dicarboxylic acid having a sulfonic acid group) other than the constituent components derived from an aliphatic dicarboxylic acid is preferably from 1 mol % to 20 mol %, and more preferably from 2 mol % to 10 mol %.

In the present specification, the term "mol %" refers to a percentage calculated for the acid-derived constituent component or the alcohol-derived constituent component, with respect to the entire acid-derived constituent components in the polyester resin or the entire alcohol-derived constituent components which are regarded as 1 unit (mol) respectively.

Alcohol-Derived Constituent Component

As an alcohol to be the alcohol-derived constituent component, an aliphatic diol is preferable, and examples thereof include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol, 1,20-eicosanediol, and the like. Among these, ethylene glycol, 1,4-butanediol, and 1,6-hexanediol are preferable.

In the present exemplary embodiment, the molecular weight of a polyester resin is measured and calculated by GPC (Gel Permeation Chromatography). Specifically, for the GPC, an HLC-8120 manufactured by TOSOH CORPORATION, a TSKgel SuperHM-M (15 cm) column manufactured by TOSOH CORPORATION, and THF solvent are used to measure the molecular weight of the polyester resin. Thereafter, a molecular weight calibration curve created using monodisperse polystyrene standard samples is used to calculate the molecular weight of the polyester resin.

Method of Preparing Polyester Resin

Methods of preparing a polyester resin are not particularly limited, and the polyester resin is prepared in a general polyester polymerization method in which an acid component is reacted with an alcohol component. For example, direct polycondensation, an ester exchange method, and the like are used depending on the types of monomers used to prepare the polyester resin. The molar ratio (acid component/alcohol component) in the reaction between the acid component and the alcohol component varies with the reaction conditions or the like, so the molar ratio may not be generally specified.

However, in order to obtain a high molecular weight, the molar ratio is preferably about 1/1 in general.

Examples of catalysts usable for preparing the polyester resin include alkali metal compounds such as sodium and lithium; alkaline earth metal compounds such as magnesium and calcium; metal compounds such as zinc, manganese, antimony, titanium, tin, zirconium, and germanium; phosphorous acid compounds; phosphoric acid compounds; amine compounds; and the like.

The content of the binder resin in the toner particles of the (a) toner containing a brilliant pigment is preferably from 50% by weight to 95% by weight, and more preferably from 60% by weight to 90% by weight.

Release Agent

Examples of the release agent used for the (a) toner containing a brilliant pigment include paraffin wax, polypropylene of a low molecular weight and polyethylene of a low molecular weight; silicone resins; rosins; rice wax; carnauba wax; and the like. The melting temperature of these release agents is preferably from 50° C. to 100° C., and more preferably from 60° C. to 95° C.

The content of the release agent in the toner particles of the (a) toner containing a brilliant pigment is preferably from 0.5% by weight to 15% by weight, and more preferably from 1.0% by weight to 12% by weight.

Other Additives

In addition to the above components, various components such as a charge-controlling agent, inorganic powder (inorganic particles), and organic particles may be optionally further added to the (a) toner containing a brilliant pigment as internal additives of the toner particles.

Examples of the charge-controlling agent include dyes including complexes of a quaternary ammonium salt compounds, a nigrosine-based compound, aluminum, iron, and chromium, triphenylmethane-based pigments, and the like.

As the inorganic particles, for example, known inorganic particles such as silica particles, titanium oxide particles, alumina particles, cerium oxide particles, or particles obtained by hydrophobizing the surface of these particles may be used alone or used in combination of two or more kinds thereof. Among these, silica particles having a refractive index lower than that of the binder resin described above are preferably used. In addition, various surface treatments may be performed on the silica particles, and for example, silica particles surface-treated with a silane coupling agent, titanium coupling agent, or silicone oil are preferably used.

External Additives

The (a) toner containing a brilliant pigment may contain a fluidizer, an auxiliary agent, and the like as external additives of the toner particles.

As the external additives, known particles such as inorganic particles like silica particles having a surface that has treated with a hydrophobizing agent, titanium oxide particles, alumina particles, cerium oxide particles, and carbon black and polymer particles such as polycarbonate, polymethyl methacrylate and a silicone resin are usable.

In the present exemplary embodiment, the amount of the external additives added is from 0.5 part by weight to 10 parts by weight, and preferably from 1.0 part by weight to 5 parts by weight, based on 100 parts by weight of the toner particles.

Characteristics of Toner Particles

Shape of Toner Particles

It is preferable that the toner particles satisfy the following (1).

(1) An average equivalent circle diameter D of the first toner particles is longer than an average maximum thickness E thereof.

The ratio (E/D) between the average maximum thickness E and the average equivalent circle diameter D preferably ranges from 0.001 to 0.500, more preferably ranges from 0.010 to 0.200, and particularly preferably ranges from 0.050 to 0.100.

If the ratio (E/D) is equal to or greater than 0.001, strength of the first toner particles is secured, and rupture caused by stress during the image formation, the decrease in charge caused by the exposure of the brilliant pigment, and fogging caused as a result of the decrease in charge are inhibited. On the other hand, if the ratio is equal to or less than 0.500, excellent brilliance is obtained.

The average maximum thickness E and the average equivalent circle diameter D are measured in the following method.

The toner particles are placed on a smooth surface, and vibration is applied thereto so as to disperse the particles without unevenness. The toner particles (1000 particles) are magnified 1000 times using a color laser microscope "VK-9700" (manufactured by Keyence Corporation), and a maximum thickness E and an equivalent circle diameter D of a surface viewed from the top are measured. The arithmetic mean thereof is calculated to calculate the average maximum thickness E and the average equivalent circle diameter D.

Angle between Major Axis Direction in Cross-section of Toner particles and Major axis direction of Pigment Particles It is preferable that the first toner particles satisfy the following (2).

(2) When the cross-section in the thickness direction of the toner particles is observed, the proportion of pigment particles (particles of brilliant pigment) of which the major axis direction forms an angle ranging from −30° to +30° with the major axis direction in the cross-section of the toner particles is equal to or more than 60% in the total pigment particles observed. This proportion is preferably from 70% to 95%, and particularly preferably from 80% to 90%.

Herein, the method of observing the cross-section of the toner particles will be described.

First, the toner particles are embedded using a bisphenol A type liquid epoxy resin and a curing agent, and then a sample for cutting is prepared. Subsequently, the cutting sample is cut at −100° C. by using a cutting machine that uses a diamond knife, for example, a LEICA Ultramicrotome (manufactured by Hitachi Technologies and Services, Ltd.), thereby preparing a sample for observation.

By using the obtained observation sample, the cross-section of the toner particles is observed with a transmission electron microscope (TEM) at around 5000× magnification. For the observed 1000 toner particles, the number of pigment particles for which the major axis direction forms an angle ranging from −30° to +30° with the major axis direction in the cross-section of the toner is counted using image analysis software, thereby calculating the proportion of the pigment particles.

The "major axis direction in the cross-section of the toner particles" indicates a direction orthogonal to the thickness direction in the toner particles in which the average equivalent circle diameter D is longer than the average maximum thickness C described above. The "major axis direction of the pigment particles" indicates a length direction in the pigment particles.

FIG. 1 is a cross-sectional view schematically showing an example of a toner particle that satisfies the above requirements (1) and (2). The schematic view shown in FIG. 1 is a cross-sectional view taken along the thickness direction of the toner particle.

A toner particle 2 shown in FIG. 1 is a flake-shape toner particle in which the equivalent circle diameter is longer than a thickness L, and contains flake-shape pigment particles 4.

It is considered that if the toner particle 2 has a long flake shape in which the equivalent circle diameter is longer than the thickness L as shown in FIG. 1, when the toner particles move to an image holding member, an intermediate transfer member, a recording medium, or the like in a step of developing or a step of transferring in image formation, the toner particles tend to move such that the charges of the toner particles are maximally erased. Therefore, it is considered that the toner particles line up such that the area in which the particles are attached becomes maximal. That is, it is considered that the flake-shape toner particles line up such that the flat surface faces the surface of a recording medium, in the recording medium to which the toner particles are finally transferred. It is also considered that even in the step of fixing in image formation, the flake-shape toner particles line up such that the flat surface faces the surface of the recording medium due to the pressure applied at the time of fixing.

Consequently, it is considered that among the flake-shape pigment particles contained in the toner particle, pigment particles that satisfy the above requirement (2) "an angle between the major axis direction in the cross-section of the toner and the major axis direction of the pigment particles ranges from −30° to +30°" line up such that the surface where the area becomes maximal faces the surface of the recording medium. It is considered that when light is emitted to an image formed in this manner, the proportion of the pigment particles that diffusely reflect the incident light is diminished, so a range of the ratio (A/B) described later is achieved.

Method of Preparing (a) Toner Containing Brilliant Pigment

The (a) toner containing a brilliant pigment may be prepared by a known method such as a wet method or a dry method, but it is particularly preferable to prepare this toner by a wet method. Examples of the wet method include a melt suspension method, an emulsification aggregation method, a dissolution suspension method, and the like. It is preferable to prepare the (a) toner containing a brilliant pigment by the emulsification aggregation method, from the viewpoint that it is easy to form a state where the brilliant pigment is not exposed to the surface by being coated with the binder resin.

In the emulsification aggregation method, dispersions (a resin particle dispersion, a colorant dispersion, and the like) are prepared by dispersing the respective materials constituting the toner in aqueous dispersions (step of emulsifying). Subsequently, a resin particle dispersion, a colorant dispersion, and various other dispersions (release agent dispersion and the like) which are optionally used are mixed so as to prepare a raw material dispersion.

Thereafter, in the raw material dispersion, a step of forming aggregated particles and a step of coalescence of the aggregated particles are performed, thereby obtaining toner particles. When a toner having a so-called core-shell structure which includes a core particle and a shell layer coating the core particle is prepared, a step of forming a coating layer is performed in which the resin particle dispersion is added to the raw material dispersion having undergone the step of forming aggregated particles so as to attach resin particles to the surface of the aggregated particles (becoming core particles when the toner is prepared) to form a coating layer (becoming a shell layer when the toner is prepared), and then the step of coalescence is performed. The resin component used in the step of forming the coating layer may be the same as or different from the resin component constituting the core particles.

Hereinbelow, the respective steps will be described in detail.

Step of Emulsifying

In order to prepare the raw material dispersion used for the step of forming the aggregated particles, an emulsion dispersion obtained by dispersing main materials constituting the toner in an aqueous medium is prepared in the step of emulsifying. The resin particle dispersion, the colorant dispersion, the release agent dispersion, and the like will be described below.

Resin Particle Dispersion

The volume average particle size of the resin particles dispersed in the resin particle dispersion may be from 0.01 μm to 1 μm, from 0.03 μm to 0.8 μm, or from 0.03 μm to 0.6 μm.

If the volume average particle size of the resin particles exceeds 1 μm, a particle size distribution of the finally obtained toner is broadened, or free particles are prepared, which easily cause the deterioration of the performance and reliability in some cases. On the other hand, if the volume average particle size is within the above range, this is preferable in the respects that the defects described above are not induced, compositional localization between the toner particles is reduced, the toner particles are excellently dispersed, and the variation in the performance and reliability is diminished.

The volume average particle size of particles contained in the raw material dispersion, such as resin particles, is measured with a laser diffraction type particle size distribution analyzer (LA-700 manufactured by HORIBA, Ltd.).

The dispersion medium used for the resin particle dispersion or for other dispersions may be an aqueous medium.

Examples of the aqueous medium include water such as distilled water or deionized water, alcohols, and the like. These media may be used alone, or two or more kinds thereof may be used concurrently. In the present exemplary embodiment, a surfactant may be added to and mixed with the aqueous medium in advance.

The surfactant is not particularly limited, and examples thereof include anionic surfactants such as a sulfuric acid ester salt-based surfactant, a sulfonic acid salt-based surfactant, a phosphoric acid ester-based surfactant, and a soap-based surfactant; cationic surfactants such as an amine salt type surfactant and a quaternary ammonium salt type surfactant; nonionic surfactants such as a polyethylene glycol-based surfactant, an alkylphenol ethylene oxide adduct-based surfactant, and a polyol-based surfactant; and the like. Among these, anionic and cationic surfactants are exemplified. The nonionic surfactant may be used concurrently with the anionic or cationic surfactant. The above surfactants may be used alone, or two or more kinds thereof may be used concurrently.

Specific examples of the anionic surfactant include sodium dodecylbenzenesulfonate, sodium dodecylsulfate, sodium alkylnaphthalenesulfonate, sodium dialkylsulfosuccinate, and the like. Specific examples of the cationic surfactant include alkylbenzenedimethylammonium chloride, alkyltrimethylammonium chloride, distearylammonium chloride, and the like. Among these, ionic surfactants such as anionic and cationic surfactants may be exemplified.

Containing a functional group which may be turned into an anionic group by neutralization, the polyester resin has self-water dispersibility. The polyester resin forms a stabilized aqueous dispersion by the action of an aqueous medium, in which a portion or all of functional groups which may be turned into hydrophilic groups are neutralized with a base.

In the polyester resin, the functional groups which may be turned into hydrophilic groups by neutralization are acidic groups such as carboxyl groups or sulfonic acid groups. Accordingly, examples of the neutralizer include inorganic alkalis such as potassium hydroxide and sodium hydroxide; amines such as ammonia, monomethylamine, dimethylamine, triethylamine, monoethylamine, diethylamine, triethylamine, mono-n-propylamine, dimethyl-n-propylamine, monoethanolamine, diethanolamine, triethanolamine, N-methylethanolamine, N-aminoethylethanolamine, N-methyldiethanolamine, monoisopropanolamine, diisopropanolamine, triisopropanolamine, and N,N-dimethylpropanolamine; and the like. One or two or more kinds of the neutralizer selected from these may be used. If these neutralizers are added, pH at the time of emulsification is controlled to be neutral, and hydrolysis of the obtained polyester resin dispersion is prevented.

When the resin particle dispersion is prepared using the polyester resin, a phase inversion emulsification method may be used. Even when the resin particle dispersion is prepared using a binder resin other than the polyester resin, the phase inversion emulsification method may be used. The phase inversion emulsification method is a method in which a resin to be dispersed is dissolved in a hydrophobic organic solvent that is able to dissolve the resin, a base is then added thereto in an organic continuous phase (O phase) to neutralize the solution, and then an aqueous medium (W phase) is added to the resultant. In this manner, the resin is converted from W/O to O/W (so-called phase inversion) and becomes a discontinuous phase, whereby the resin is stably dispersed in the aqueous medium in the shape of particles.

Examples of the organic solvent used for the phase inversion emulsification include alcohols such as ethanol, n-propanol, isopropanol, n-butanol, isobutanol, sec-butanol, tert-butanol, n-amylalcohol, isoamylalcohol, sec-amylalcohol, tert-amylalcohol, 1-ethyl-1-propanol, 2-methyl-1-butanol, n-hexanol, and cyclohexanol; ketones such as methyl ethyl ketone, methyl isobutyl ketone, ethyl butyl ketone, cyclohexanone, and isophorone; ethers such as tetrahydrofuran, dimethyl ether, diethyl ether, and dioxane; esters such as methyl acetate, ethyl acetate, n-propyl acetate, isopropyl acetate, n-butyl acetate, isobutyl acetate, sec-butyl acetate, 3-methoxybutyl acetate, methyl propionate, ethyl propionate, butyl propionate, dimethyl oxalate, diethyl oxalate, dimethyl succinate, diethyl succinate, diethyl carbonate, and dimethyl carbonate; glycol derivatives such as ethylene glycol, ethylene glycol monomethyl ether, ethylene glycol monoethyl ether, ethylene glycol monopropyl ether, ethylene glycol monobutyl ether, ethylene glycol ethyl ether acetate, diethylene glycol, diethylene glycol monomethyl ether, diethylene glycol monoethyl ether, diethylene glycol monopropyl ether, diethylene glycol monobutyl ether, diethylene glycol ethyl ether acetate, propylene glycol, propylene glycol monomethyl ether, propylene glycol monopropyl ether, propylene glycol monobutyl ether, propylene glycol methyl ether acetate, and dipropylene glycol monobutyl ether; 3-methoxy-3-methylbutanol; 3-methoxybutanol; acetonitrile; dimethylformamide; dimethylacetamide; diacetone alcohol; ethyl acetoacetate; and the like. These solvents may be used alone, or two or more kinds thereof may be used concurrently.

It is difficult to generally determine the amount of the organic solvent used for the phase inversion emulsification, since the amount of the solvent used for obtaining a desired dispersion particle size varies with the physical properties of the resin. However, in the present exemplary embodiment, when the content of a tin compound catalyst in the resin is larger than that in the general polyester resin, the amount of the solvent with respect to the weight of the resin may be relatively large. When the amount of the solvent is small, emulsifying properties become insufficient, whereby the particle size of the resin particles is enlarged, or the particle size distribution is broadened in some cases.

For the purpose of stabilizing dispersed particles or preventing viscosity increase in the aqueous medium at the time of phase inversion emulsification, a dispersant may be added. Examples of the dispersant include water-soluble polymers such as polyvinyl alcohol, methyl cellulose, ethyl cellulose, hydroxyethyl cellulose, carboxymethyl cellulose, sodium polyacrylate, and sodium polymethacrylate; surfactants such as an anionic surfactant, a cationic surfactant, a zwitterionic surfactant, and a nonionic surfactant; and the like. These dispersants may be used alone, or two or more kinds thereof may be used in combination. The dispersant may be added in an amount of from 0.01 part by weight to 20 parts by weight, based on 100 parts by weight of the binder resin.

The emulsification temperature at the time of the phase inverse emulsification may be equal to or lower than the boiling point of the organic solvent and equal to or higher than the melting temperature or the glass transition temperature of the binder resin. When the emulsification temperature is lower than the melting temperature or the glass transition temperature of the binder resin, it is difficult to prepare the resin particle dispersion. When the emulsification is performed at a temperature equal to or higher than the boiling point of the organic solvent, the emulsification may be performed in an apparatus that is pressurized and sealed.

The content of the resin particles contained in the resin particle dispersion may be from 5% by weight to 50% by weight, or from 10% by weight to 40% by weight in general. If the content is out of this range, the particle size distribution of the resin particles is broadened, and the characteristics deteriorate in some cases.

Colorant Dispersion

The brilliant pigment is used as a colorant in the present exemplary embodiment, so a colorant dispersion containing this brilliant pigment is used.

As the dispersing method used for preparing the colorant dispersion, for example, general dispersing methods using a rotating shear type homogenizer, a ball mill including media, a sand mill, a dyno mill, or the like may be used, but the methods are not limited. Optionally, an aqueous dispersion of the colorant may be prepared using a surfactant, or an organic solvent dispersion of the colorant may be prepared using a dispersant. As the surfactant and the dispersant used for dispersing, the same ones as the dispersant used for dispersing the binder resin may be used.

When the raw material dispersion is prepared, the colorant dispersion may be mixed at once with the dispersion in which other particles have been dispersed, or be added to and mixed with the dispersion many times in separate portions.

The content of the colorant contained in the colorant dispersion may be from 5% by weight to 50% by weight, or from 10% by weight to 40% by weight in general. If the content is out of this range, the particle size distribution of the colorant particles is broadened, and the characteristics deteriorate in some cases.

Release Agent Dispersion

The release agent dispersion is prepared by dispersing a release agent in water together with an ionic surfactant and the like, heating the resultant at a temperature equal to or higher than the melting temperature of the release agent, and applying a strong shearing force thereto by using a homogenizer or a pressure discharge type dispersing machine. In this manner, release agent particles having a volume average particle size of equal to or less than 1 μm are dispersed. As a dispersion medium in the release agent dispersion, the same one as the dispersion medium used for the binder resin may be used.

As the apparatus that mixes the binder resin, the colorant, and the like with the dispersion medium for performing emulsification and dispersion, known apparatuses are usable. For example, Homo Mixer (manufactured by PRIMIX Corporation) or continuous emulsifying and dispersing machines such as Slasher (manufactured by Mitsui Mining Co., Ltd.), Cavitron (manufactured by Eurotec Co, Ltd.) microfluidizer (manufactured by Mizuho industrial Co., Ltd.), Manton-Gaulin homogenizer (manufactured by Manton-Gaulin Company), Nanomizer (manufactured by NANOMIZER Inc.), and Static Mixer (manufactured by Noritake. Co., Limited) are used.

In addition, according to the purpose, the release agent and the internal additives (components such as a charge-controlling agent and inorganic powder) described above may be dispersed in advance in the binder resin dispersion.

When dispersions of components other than the binder resin, the colorant, and the release agent are prepared, the volume average particle size of the particles dispersed in the dispersions may be equal to or less than 1 μm or from 0.01 μm to 0.5 μm in general. If the volume average particle size exceeds 1 μm, the particle size distribution of the finally obtained toner is broadened, or free particles are prepared, which causes deterioration of the performance and reliability in some cases. On the other hand, if the volume average particle size is within the above range, this is preferable in the respects that the defects described above are not induced, compositional localization between the toner particles is reduced, the toner particles are excellently dispersed, and the variation in the performance and reliability is diminished.

Step of Forming Aggregated Particles

In the step of forming aggregated particles (step of preparing a dispersion of aggregated particles), the colorant dispersion and the release agent dispersion are added in general in addition to the resin particle dispersion, and at least other dispersions that are optionally added are mixed with the resultant to obtain a raw material dispersion. An aggregation agent is further added thereto, followed by heating to aggregate the particles, thereby forming aggregated particles. When the resin particles are a crystalline resin such as crystalline polyester, the particles are heated at a temperature near (±20° C.) the melting temperature of the crystalline resin and at a temperature equal to or lower the melting temperature to aggregate the particles, thereby forming aggregated particles.

By adjusting the heating temperature and the heating time in the step of forming aggregated particles, the particle size of the toner particles becomes controllable. That is, by adjusting the heating temperature and the heating time in the step of forming aggregated particles, toner particles having the volume average particle size as described above are obtained.

The aggregation agent is added at room temperature while the raw material dispersion is stirred with a rotating shear type homogenizer, and pH of the raw material dispersion is adjusted to be acidic, thereby forming the aggregated particles. In addition, in order to inhibit rapid aggregation caused by heating, the pH adjustment may be carried out at the stage of stirring and mixing performed at room temperature, and a dispersion stabilizer may be optionally added thereto.

In the present exemplary embodiment, "room temperature" refers to 25° C.

As the aggregation agent used in the step of forming aggregated particles, surfactants having a polarity opposite to that of surfactants used as the dispersant added to the raw material dispersion, that is, a metal complex having a valency of equal to or higher than 2 are suitably used in addition to an inorganic metal salt. Particularly, when the metal complex is used, the amount of the surfactant used may be reduced, and the charging characteristics are improved.

In addition, an additive that forms a complex or a bond similar to the complex with metal ions of the aggregation agent may be optionally used. As the additive, a chelating agent is suitably used.

Examples of the inorganic metal salt include metal salts such as calcium chloride, calcium nitrate, barium chloride, magnesium chloride, zinc chloride, aluminum chloride, and aluminum sulfate; inorganic metal salt polymers such as polyaluminum chloride, polyaluminum hydroxide, and calcium polysulfide; and the like. Among these, aluminum salts and a polymer thereof are particularly suitable. In order to obtain a sharper particle size distribution, a divalent inorganic metal salt is more suitable than a monovalent inorganic metal salt, a trivalent inorganic metal salt is more suitable than a divalent inorganic metal salt, and a quadrivalent inorganic metal salt is more suitable than a trivalent inorganic metal salt. Moreover, among inorganic metal salts having the same valency, polymerization type of inorganic metal salt polymers are more suitable.

As the chelating agent, a water-soluble chelating agent may be used. A water-insoluble chelating agent is poorly dispersed in the raw material dispersion, and with such an agent, metal ion capturing caused by the aggregation agent becomes insufficient in the toner in some cases.

The chelating agent is not particularly limited so long as this agent is a known water-soluble chelating agent. For example, oxycarboxylic acids such as tartaric acid, citric acid, and gluconic acid, iminodiacetic acid (IDA), nitrilotriacetic acid (NTA), ethylenediaminetetraacetic acid (EDTA), and the like may be suitably used.

The amount of the chelating agent added may range from 0.01 part by weight to 5.0 parts by weight, or may be equal to or more than 0.1 part by weight and less than 3.0 parts by weight, based on 100 parts by weight of the binder resin. If the amount of the chelating agent added is less than 0.01 part by weight, the effect obtained by adding the chelating agent is not exerted in some cases. On the other hand, if the amount exceeds 5.0 parts by weight, charging properties are negatively affected, and viscoelasticity of the toner changes dramatically. Accordingly, fixing properties at low temperature and image glossiness are negatively affected in some cases.

The chelating agent may be added while the step of forming aggregated particles or the step of forming a coating layer is being performed, or may be added before or after the step is performed. The chelating agent may be added at room temperature without the necessity of adjusting the temperature of the raw material dispersion for the addition, or may be added after it is adjusted to be the internal temperature of the tank used in the step of forming aggregated particles or the step of forming a coating layer.

Step of Forming Coating Layer

If necessary, a step of forming a coating layer may be performed after the step of forming aggregated particles ends. In the step of forming a coating layer, resin particles for forming a coating layer are attached onto the surface of the aggregated particles that are formed by the step of forming aggregated particles, thereby forming a coating layer. In this manner, a toner having a so-called core-shell structure is obtained.

Generally, the resin particle dispersion is further added to the raw material dispersion in which the aggregated particles (core particles) are formed by the step of forming aggregated particles, thereby forming the coating layer.

After the step of forming a coating layer ends, a step of coalescence is performed. However, the step of forming a coating layer and the step of coalescence may be repeated alternately so as to form the coating layer in separate multiple stages.

Step of Coalescence

In the step of coalescence that is performed after the step of forming aggregated particles ends or after the step of forming aggregated particles and the step of forming a coating layer end, pH of a suspension which contains the aggregated particles formed by these steps is adjusted in a range of about from 6.5 to 8.5, thereby stopping the progress of the aggregation.

After the progress of the aggregation is stopped, heating is performed to cause the aggregated particles to coalesce. The heating may be performed at a temperature equal to or higher than the melting temperature of the binder resin so as to cause the aggregated particles to coalesce.

Steps of Washing, Drying, and the Like

After the step of coalescence of the aggregated particles ends, the desired toner particles are obtained through a step of washing, a step of solid-liquid separation, and a step of drying. In the step of washing, it is preferable to remove the dispersant attached to the toner particles by using an aqueous solution of strong acid such as hydrochloric acid, sulfuric acid, or nitric acid and to subsequently wash the resultant with deionized water or the like until the filtrate becomes neutral. The step of solid-liquid separation is not particularly limited, but in view of productivity, suction filtration, pressurizing filtration, and the like are suitable. In addition, the step of drying is not particularly limited, but in view of productivity, freeze drying, flash jet drying, fluidizing drying, vibration type fluidization drying, and the like may be used.

In the step of drying, the moisture content of the toner particles after drying may be adjusted to equal to or less than 1.0% by weight or to equal to or less than 0.5% by weight.

When prepared by the emulsification aggregation method, the toner particles that contain the brilliant pigment as a colorant are preferably prepared by, for example, the following preparation method.

First, pigment particles are prepared, and the pigment particles and a binder resin are dispersed and dissolved in a solvent so as to be mixed. The mixture is dispersed in water by phase inversion emulsification or shearing emulsification, thereby forming brilliant pigment particles coated with the resin. Other compositions (for example, a release agent, a resin for a shell, and the like) are added to the particles, and an aggregation agent is further added thereto. The temperature of the resultant is raised to around the glass transition temperature (Tg) of the resin under stirring, thereby forming aggregated particles. In this step, for example, a stirring blade that has two paddles and forms a laminar flow is used, and the stirring is performed at a high stirring speed (from 500 rpm to 1500 rpm, for example). In this manner, the brilliant pigment particles are oriented in the major axis direction in the aggregated particles, and the aggregated particles also aggregate in the major axis direction, whereby the thickness of the toner is reduced. The toner particles are turned into alkaline particles so as to finally stabilize the particles, and then the temperature is raised to a temperature between the glass transition temperature (Tg) and the melting temperature (Tm) of the toner, thereby causing the aggregated particles to coalesce. In this step of coalescence, the coalescence is carried out at a lower temperature (from 60° C. to 80° C., for example), whereby the movement caused by the rearrangement of the materials is reduced, and toner particles in which the orientation of the pigment is maintained are obtained.

By the method described above, toner particles from which an image having excellent brilliance is obtained are obtained.

The stirring speed described above is more preferably from 650 rpm to 1130 rpm, and particularly preferably from 760 rpm to 870 rpm. In addition, the temperature of the coalescence in the step of coalescence is more preferably from 63° C. to 75° C., and particularly preferably from 65° C. to 70° C.

Step of Adding External Additives

External additives are optionally added externally to the toner particles obtained in the above manner.

Examples of the method of externally adding the external additives include mixing methods that uses known mixers such as a V-blender, a Henschel mixer, and a Lodige mixer.

Characteristics of (a) Toner Containing Brilliant Pigment

When a solid image is formed using the (a) toner containing a brilliant pigment according to the present exemplary embodiment, a ratio (F/G) between a reflectance F at a light-receiving angle of +30° and a reflectance G at a light-receiving angle of −30°, which are reflectances measured when incident light having an angle of incidence of −45° enters the image from a goniophotometer, is preferably from 2 to 100.

If the ratio (F/G) is equal to or greater than 2, this indicates light is reflected more toward a side ("angle+" side) opposite to the light incident side than toward a side ("angle−" side) where the incident light enters, that is, this indicates diffused reflection of the incident light is inhibited. When the diffused reflection in which the incident light is reflected to various directions is caused, if the reflected light is visually checked, colors look blurry. Therefore, when the ratio (F/G) is equal to or greater than 2, if the reflected light is visually checked, glossiness is confirmed, which indicates excellent brilliance.

On the other hand, if the ratio (F/G) is equal to or less than 100, a view angle in which the reflected light may be visually checked is not narrowed too much, and a phenomenon in which colors look darkish depending on the angle is prevented.

The ratio (F/G) is more preferably from 20 to 90, and particularly preferably from 40 to 80.

Goniophotometric Measurement of Ratio (F/G)

First, an angle of incidence and a light-receiving angle will be described. In the present exemplary embodiment, the angle of incidence is set to −45° when the measurement is performed using a goniophotometer. This is because the sensitivity of the measurement is high with respect to images of a wide range of glossiness.

In addition, the reason why the light-receiving angle is set to −30° and +30° is that the sensitivity of the measurement becomes the highest for evaluating images having and not having the impression of brilliance.

Next, the method of measuring the ratio (F/G) will be described.

In the present exemplary embodiment, for measuring the ratio (F/G), first, a "solid image" is formed in the following manner. A developer as a sample is filled in a developing unit of a DocuCentre-III C7600 manufactured by Fuji Xerox Co., Ltd., and a solid image in which an amount of toner applied is 4.5 g/cm$^2$ is formed on a sheet of recording paper (OK Topcoat+Paper manufactured by Oji paper Co., Ltd.) at a fixing temperature of 190° C. and at a fixing pressure of 4.0 kg/cm$^2$. The "solid image" refers to an image of a 100% printing rate.

By using a goniospectrocolorimeter GC5000L manufactured by Nippon Denshoku Industries Co., Ltd. as a goniophotometer, incident light that enters the solid image at an angle of incidence of −45° enters the image portion of the formed solid image, and the reflectance F at a light-receiving angle of +30° and the reflectance G at a light-receiving angle of −30° are measured. The reflectances F and G are measured with respect to light having a wavelength ranging from 400 nm to 700 nm at an interval of 20 nm, and an average of the reflectance at each wavelength is calculated. The ratio (F/G) is calculated from the measurement results.

(b) Toner not Containing Brilliant Pigment (Second Toner)

In the present exemplary embodiment, the (b) toner not containing a brilliant pigment refers to a toner that does not contain a brilliant pigment as a colorant.

The (b) toner not containing a brilliant pigment has a volume average particle size represented by B.

As described above, B needs to satisfy (2): 1 μm≤B≤15 μm (preferably (6) 5 μm≤B≤10 μm). That is, the volume average particle size of the (b) toner not containing a brilliant pigment is from 1 μm to 15 μm and preferably from 5 μm to 10 μm.

If the volume average particle size of the (b) toner not containing a brilliant pigment is smaller than 1 μm, the external additives are embedded in the toner particles due to the stress caused by the carrier, and efficiency of transfer of the toner is decreased, whereby fine line reproducibility deteriorates in some cases.

On the other hand, when the volume average particle size of the (b) toner not containing a brilliant pigment is larger than 15 μm, the particle size becomes too large, whereby the fine line reproducibility at the time of image formation deteriorates in some cases.

The volume average particle size of the (b) toner not containing a brilliant pigment refers to a particle size in a state where the toner does not contain the external additives, and is measured by the same method as used for the (a) toner containing a brilliant pigment.

The components constituting the (b) toner not containing a brilliant pigment are the same as those constituting the (a) toner containing a brilliant pigment, except that the brilliant pigment and other colorants are not contained in the components.

The content of the components constituting the (b) toner not containing a brilliant pigment is the same as the content of the components constituting the (a) toner containing a brilliant pigment, except for the content of the binder resin.

In a case of the (b) toner not containing a brilliant pigment, the content of the binder resin in the toner particles is preferably from 80% by weight to 98% by weight, and more preferably from 85% by weight to 95% by weight.

Method of preparing (b) Toner not Containing Brilliant Pigment

The (b) toner not containing a brilliant pigment may be prepared in the same manner as in the (a) toner containing a brilliant pigment, except that the brilliant pigment and other colorants are not used (a colorant dispersion is not used in a case of the emulsification aggregation method).

When the (a) toner containing a brilliant pigment is prepared, the (b) toner not containing a brilliant pigment may be additionally prepared. That is, when the (a) toner containing a brilliant pigment is prepared, this toner may be prepared while being mixed with the (b) toner not containing a brilliant pigment. In this case, this mixed toner is applicable to the developer according to the present exemplary embodiment.

As one of the methods that additionally prepare the (b) toner not containing a brilliant pigment when the (a) toner containing a brilliant pigment is prepared, there is the following method using the emulsification aggregation method.

That is, through the following steps, a toner in which the proportion of the toner not containing a brilliant pigment in the entire toner ranges from 5% to 80% in terms of the number of the toner particles may be obtained.

For example, the method includes a step of preparing a dispersion of first aggregated particles, wherein a brilliant pigment dispersion (colorant dispersion) containing a brilliant pigment is mixed with a dispersion of first binder resin particles containing the first binder resin to prepare the dispersion of first aggregated particles containing the brilliant pigment and the first binder resin; a step of preparing a dispersion of second aggregated particles, wherein the dispersion of the second aggregated particles containing a second binder resin is prepared using a dispersion of second binder resin particles containing the second binder resin; a step of accelerating aggregation, wherein the dispersion of the first aggregated particles is mixed with the dispersion of the second aggregated particles such that the ratio (based on weight) between the first binder resin and the second binder resin becomes 3:97 to 48:52, thereby further accelerating the aggregation of the first and second aggregated particles; and a step of coalescence, wherein heating is performed to cause the first and second aggregated particles to coalesce.

The ratio (based on weight) between the first and second binder resins is preferably 6:94 to 30:70, and more preferably 9:91 to 24:76.

In the steps of preparing dispersions of the first and second aggregated particles, the type of the first and second binder resins may be the same as or different from each other.

A release agent or the like that is optionally used may be added as a release agent dispersion in the step of preparing the dispersion of the first or second aggregated particles.

Between the step of accelerating aggregation and the step of coalescence, a step of forming a coating layer may be included.

(c) Carrier

In the present exemplary embodiment, (c) a carrier has a volume average particle size represented by C.

The relationship between C and the volume average particle size A of the (a) toner containing a brilliant pigment described above needs to satisfy (3): 3.0≤C/A≤5.0 (preferably (7): 3.5≤C/A≤4.5).

If C/A is smaller than 3.0, the carrier moves to the toner image together with the (a) toner containing a brilliant pigment, so the fine line reproducibility at the time of image formation deteriorates in some cases.

If C/A is larger than 5.0, the contact area between the carrier and the (a) toner containing a brilliant pigment becomes large, and a non-electrostatic attaching force is increased. Consequently, the efficiency of transfer of the toner is decreased, and the fine line reproducibility at the time of image formation deteriorates in some cases.

The relationship between the volume average particle size C of the carrier and the volume average particle size B of the (b) toner not containing a brilliant pigment needs to satisfy (4): 5.0≤C/B≤20.0 (preferably (8): 7.0≤C/B≤12.0).

If C/B is smaller than 5.0, the particle size of the carrier becomes close to the particle size of the (b) toner not containing a brilliant pigment. Consequently, transfer of the (b) toner not containing a brilliant pigment from the carrier is hindered, and the fine line reproducibility at the time of image formation deteriorates in some cases.

If C/B is larger than 20.0, external additives are embedded in the toner particles in the (b) toner not containing a brilliant pigment due to the stress of the carrier, the efficiency of transfer of the toner is decreased, and the fine line reproducibility deteriorates in some cases.

The volume average particle size C of the (c) carrier just needs to satisfy the above conditions (3) and (4), but generally, the volume average particle size is preferably from 25 μm to 95 μm, and more preferably from 35 μm to 75 μm.

For measuring the volume average particle size C of the carrier, the same method as used for the (a) toner containing a brilliant pigment is employed.

As the (c) carrier, known carriers are used without particular limitation. Examples of the carrier include magnetic metals such as iron oxide, nickel, and cobalt; magnetic oxides such as ferrite and magnetite; resin-coated carriers which include these components as a core which has a resin coating layer on the surface; dispersed magnetic carriers; and the like. The (c) carrier may be a dispersed resin carrier in which a conductive material or the like has been dispersed in a matrix resin.

Examples of the coating resin and the matrix resin used for the carrier include, but are not limited to, polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a linear silicone resin including an organosiloxane bond or a modified product thereof, a fluororesin, polyester, polycarbonate, a phenol resin, an epoxy resin, and the like.

Examples of the conductive material include, but are not limited to, metals such as gold, silver, and copper, carbon black, titanium oxide, zinc oxide, barium sulfate, aluminum borate, potassium titanate, tin oxide, and the like.

Examples of the core of the carrier include magnetic metals such as iron, nickel, and cobalt, magnetic oxides such as ferrite and magnetite, glass beads, and the like. In order to use the carrier in a magnetic brush method, the core is preferably a magnetic material.

For coating the surface of the carrier core with a resin, for example, a method of coating the surface by using a solution for forming a coating layer which is obtained by dissolving the coating resin and optionally various additives in an appropriate solvent is used. The solvent is not particularly limited and may be selected in consideration of the coating resin to be used, coating suitability, and the like.

Specific examples of the method of coating a resin include a method of dipping the carrier core in the solution for forming a coating layer, a method of spraying the solution for forming a coating layer to the surface of the carrier core, a fluidized bed method in which the solution for forming a coating layer is sprayed in a state where the carrier core is floated by flowing air, a kneader coater method in which the carrier core is mixed with the solution for forming a coating layer in a kneader coater to remove the solvent, and the like.

In the developer according to the present exemplary embodiment, the mixing ratio (weight ratio) between the toner (the total amount of the first toner and the second toner) and the carrier preferably ranges from 1:100 to 30:100 (toner: carrier) and more preferably ranges from 3:100 to 20:100.

If the mixing ratio between the toner and the carrier is in the above range, an appropriate charge amount may be secured, whereby a developer which is not easily affected by the surrounding temperature and humidity is obtained.

In the developer according to the present exemplary embodiment, the mixing ratio (weight ratio) between the first toner and the second toner preferably ranges from 60:40 to 98:2 (the first toner: the second toner), and more preferably ranges from 70:30 to 95:5.

If the mixing ratio between the first toner and the second toner is within the above range, the brilliant toner easily contacts the carrier surface, and the fluidity of the developer may be obtained. Consequently, a toner having excellent fine line reproducibility is obtained.

In the developer according to the present exemplary embodiment, the first toner and the second toner are distinguished by using the composition or the shape of the toner, and the proportion of the second toner in the entire toner may be from 5% to 80% in terms of the number of the toner particles.

In addition, the proportion of the first toner or the second toner in the entire toner refers to a value obtained by the following method.

First, the toner particles are embedded using a bisphenol A type liquid epoxy resin and a curing agent, and then a sample for cutting is prepared. Thereafter, the cutting sample is cut with a cutting machine using a diamond knife, for example, a LEICA Ultramicrotome (manufactured by Hitachi Technologies and Services, Ltd.) at −100° C., thereby preparing a sample for observation. The observation sample is observed with a TEM at around 5000× magnification.

The brilliant pigment includes a composition different from that of the binder resin and has a characteristic flake shape. Accordingly, the brilliant pigment is distinguished based on the difference in the light and shade and the shape of the observed image. The portions that are shown as a rod shape in the inside of the cross-section of the toner particles and exhibit different contrast are determined to be the brilliant pigment.

In this manner, the cross-sections of 5000 toner particles are observed, and among these, the proportion of the number of the particles having and not having the brilliant pigment is calculated.

Image Forming Apparatus and Image Forming Method

An image forming apparatus according to the present exemplary embodiment includes an image holding member; a charging unit that charges a surface of the image holding member; a latent image-forming unit that forms an electrostatic latent image on the surface of the image-holding member; a developing unit that forms a toner image by developing the electrostatic latent image formed on the surface of the image holding member by using a developer; and a transfer unit that transfers the developed toner image to a transfer medium, wherein the developer is the electrostatic charge image developer according to the present exemplary embodiment.

An image forming method according to the present exemplary embodiment includes charging a surface of the image holding member; forming an electrostatic latent image on the surface of the image holding member; forming a toner image by developing the electrostatic latent image formed on the surface of the image holding member by using a developer; and transferring the developed toner image to a transfer medium, wherein the developer is the electrostatic charge image developer according to the present exemplary embodiment.

Figure 2:
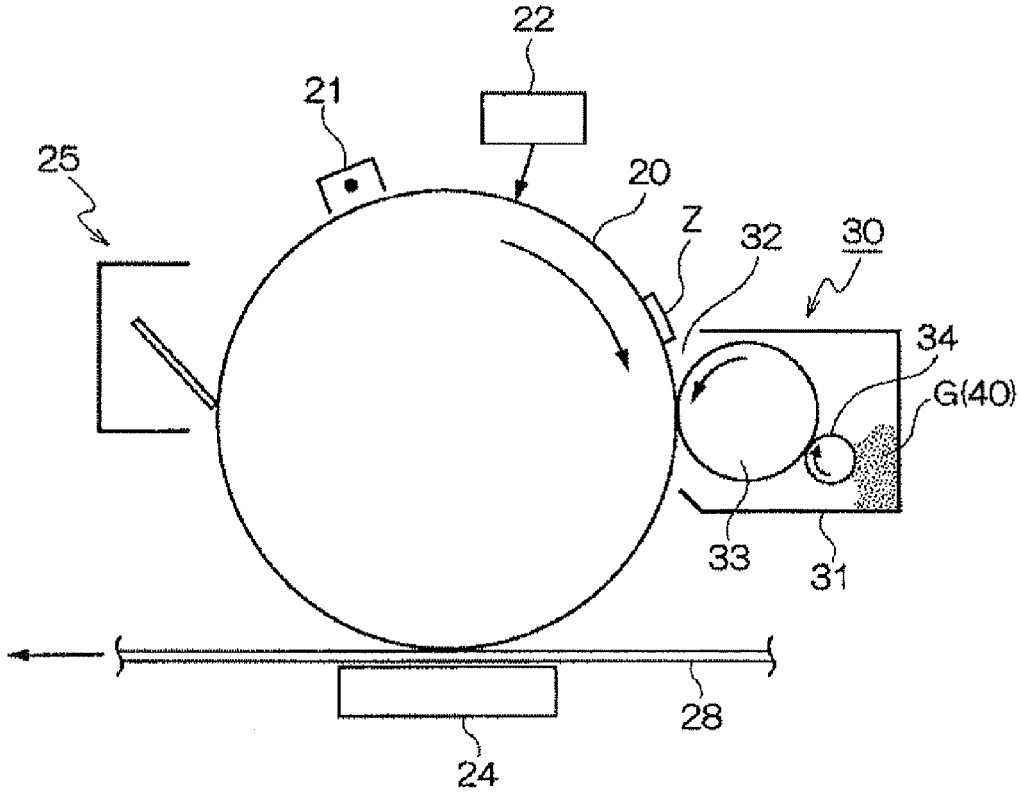
FIG. 2 is a schematic constitutional view showing an image forming apparatus to which the present exemplary embodiment is applied.

FIG. 2 is a schematic constitutional view showing the exemplary embodiment of an image forming apparatus that includes a developing device using the developer according to the present exemplary embodiment.

In this drawing, the image forming apparatus according to the present exemplary embodiment includes a photoreceptor drum 20 as an image holding member that rotates in a predetermined direction. Around the photoreceptor drum 20, a charging device 21 that charges the photoreceptor drum 20, an exposing device 22 for example as a latent image-forming device that forms an electrostatic latent image Z on the photoreceptor drum 20, a developing device 30 that develops the electrostatic latent image Z formed on the photoreceptor drum 20 into a visual image, a transfer device 24 that transfers a toner image having become a visual image on the photoreceptor drum 20 to a recording paper 28 as a recording medium, and a cleaning device 25 that cleans the residual toner on the photoreceptor drum 20 are arranged in order.

In the present exemplary embodiment, as shown in FIG. 2, the developing device 30 includes a developing housing 31 that accommodates a developer G containing a toner 40. In the developing housing 31, an opening for developing 32 facing the photoreceptor drum 20 is opened, and a developing roll (developing electrode) 33 as a toner-holding member facing the opening for developing 32 is disposed. When a predetermined developing bias is applied to the developing roll 33, an electric field of developing is formed in a developing area which is an area interposed between the photoreceptor drum 20 and the developing roll 33. In addition, a charge-injecting roll (injecting electrode) 34 as a charge-injecting member that faces the developing roll 33 is disposed in the developing housing 31. Particularly, in the present exemplary embodiment, the charge-injecting roll 34 also functions as a toner-supplying roll that supplies the toner 40 to the developing roll 33.

Herein, the rotation direction of the charge-injecting roll 34 is not particularly determined. However, in consideration of the properties relating to the supply of the toner and the characteristics relating to the injection of charge, a constitution is preferable in which the charge-injecting roll 34 rotates in the same direction with a circumferential speed difference (for example, equal to or more than 1.5 times) in a portion facing the developing roll 33 such that the toner 40 is inserted into the area interposed between the charge-injecting roll 34 and the developing roll 33, and injects charge while sliding.

Next, the operation of the image forming apparatus according to the exemplary embodiment will be described.

When an image forming process begins, first, the surface of the photoreceptor drum 20 is charged due to the charging device 21, the exposing device 22 writes the electrostatic latent image Z on the charged photoreceptor drum 20, and the developing device 30 visualizes the electrostatic latent image Z as a toner image. Subsequently, the toner image on the photoreceptor drum 20 is transported to a transfer portion, and the transfer device 24 electrostatically transfers the toner image on the photoreceptor drum 20 to the recording paper as a recording medium. The residual toner on the photoreceptor drum 20 is cleaned by the cleaning device 25. Thereafter, the toner image on the recording paper 28 is fixed by a fixing device not shown in the drawing, whereby an image is obtained.

Process Cartridge

A process cartridge for an image forming apparatus according to the present exemplary embodiment includes an image holding member; and a developing unit that forms a toner image by developing an electrostatic latent image formed on a surface of the image holding member by using a developer, wherein the developer is the electrostatic charge image developer according to the present exemplary embodiment.

Figure 3:
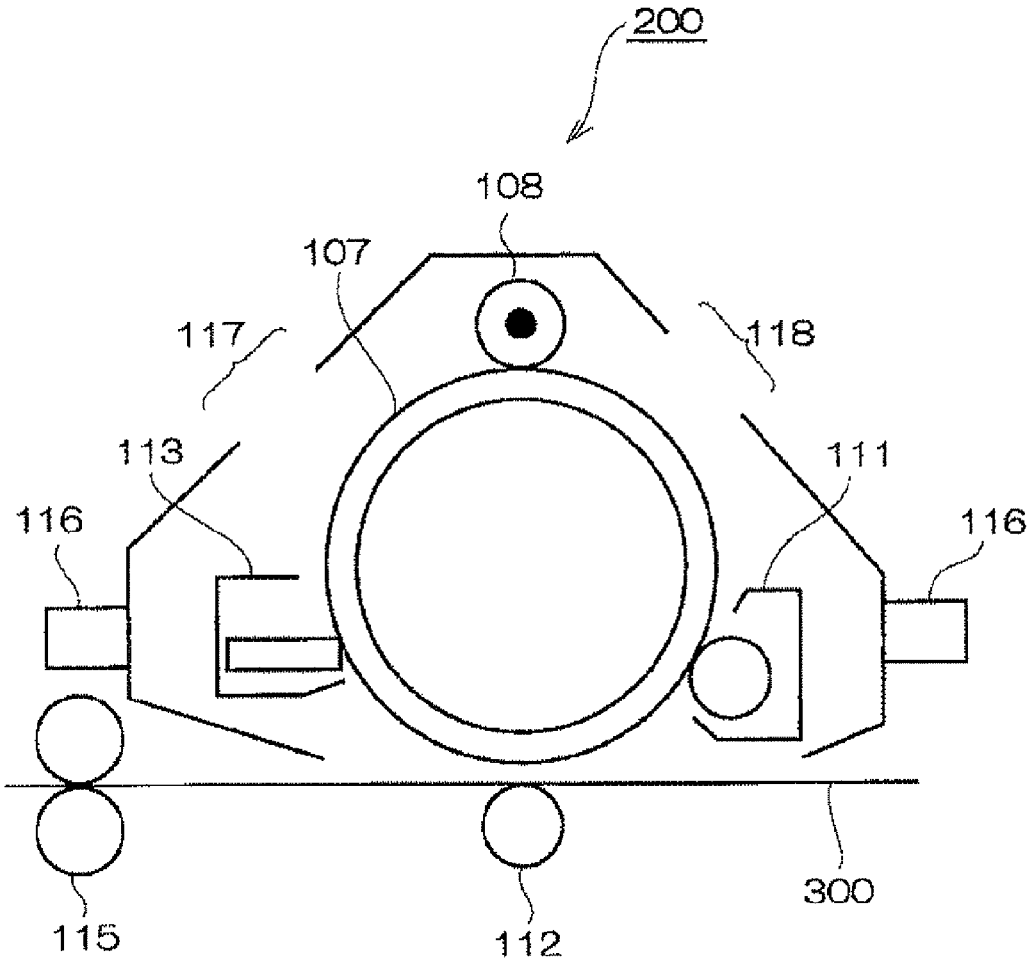
FIG. 3 is a schematic constitutional view showing an example of a process cartridge of the present exemplary embodiment.

FIG. 3 is a schematic constitutional view showing an example of the process cartridge according to the present exemplary embodiment. The process cartridge according to the present exemplary embodiment includes a developing device that accommodates the above developer according to the present exemplary embodiment and forms a toner image by developing the electrostatic latent image formed on the surface of the image holding member by using the developer. The process cartridge is also detachable from and attachable to the image forming apparatus.

A process cartridge 200 shown in FIG. 3 is formed by combining and integrating a photoreceptor 107 as an image holding member with a charging device 108, a developing device 111 that contains the above developer according to the present exemplary embodiment, a photoreceptor-cleaning device 113, an opening portion 118 for exposing, and an opening portion 117 for erasing exposure, by using an installation rail 116. This process cartridge 200 is freely attachable to and detachable from the body of an image forming apparatus constituted with a transfer device 112, a fixing device 115, and other constitutional portions not shown in the drawing. The process cartridge 200 constitutes the image forming apparatus together with the body of the image forming apparatus.

In FIG. 3, a reference numeral 300 indicates recording paper as a recording medium.

The process cartridge 200 shown in FIG. 3 has a constitution including the charging device 108, the developing device 111, the photoreceptor-cleaning device 113, the opening portion 118 for exposing, and the opening portion 117 for erasing exposure. The process cartridge according to the present exemplary embodiment just needs to include at least the developing device 111, and other devices may be optionally combined. That is, the process cartridge according to the present exemplary embodiment includes at least one kind selected from a group consisting of the photoreceptor 107, the charging device 108, the photoreceptor-cleaning device (cleaning unit) 113, the opening portion 118 for exposing, and the opening portion 117 for erasing exposure, in addition to the developing device 111.

Next, a toner cartridge will be described. The toner cartridge accommodates the toner constituting the above-described developer according to the present exemplary embodiment and is freely attachable to and detachable from the image forming apparatus. The toner cartridge may supply the accommodated toner to the developing device provided inside the image forming apparatus. The toner cartridge just needs to accommodate at least the toner, and depending on the mechanism of the image forming apparatus, the toner cartridge may accommodate the developer according to the present exemplary embodiment.

The image forming apparatus shown in FIG. 2 has a constitution which makes the toner cartridge (not shown in the drawing) be freely attached to or detached from the apparatus. The developing device 30 is connected to the toner cartridge through a toner supply tube not shown in the drawing. When the toner accommodated in the toner cartridge is reduced, the toner cartridge may be replaced.

EXAMPLES

The present exemplary embodiment will be described below in more detail based on examples and comparative examples, but the present exemplary embodiment is not limited to the following examples. In addition, "part(s)" and "%" are based on weight unless otherwise specified.

Preparation of Toner Particles

Preparation of Toner Particles 1

Synthesis of Amorphous Polyester Resin

Bisphenol A ethylene oxide 2 mol adduct: 216 parts

Ethylene glycol: 38 parts

Terephthalic acid: 136 parts

Isophthalic acid: 80 parts

Tetrabutoxytitanate (catalyst): 0.037 parts

The above components are put in a two-neck flask dried by heating, nitrogen gas is put into the container to maintain an inert gas atmosphere, and the temperature is raised under stirring. Thereafter, a copolycondensation reaction is caused at 160° C. for 7 hours, and then the temperature is raised to 220° C. while the pressure is slowly reduced to 10 Torr, and the temperature is held for 4 hours. The pressure is temporarily returned to normal pressure, and then 9 parts of trimellitic anhydride is added. The pressure is then slowly reduced again to 10 Torr, and the temperature is held at 220° C. for an hour, thereby synthesizing an amorphous polyester resin.

Preparation of amorphous polyester resin particle dispersion

Amorphous polyester resin: 160 parts

Ethyl acetate: 233 parts

Aqueous sodium hydroxide solution (0.3 N): 0.1 part

The above components are put in a 1000 ml separable flask, followed by heating at 70° C., and the resultant is stirred with a Three-One motor (manufactured by Shinto Scientific Co., Ltd.), thereby preparing a polyester resin mixture solution. While this polyester resin mixture solution is further stirred, 373 parts of deionized water is slowly added thereto to cause phase inversion emulsification, and the solvent is removed, thereby obtaining an amorphous polyester resin particle dispersion (solid content concentration: 300).

Synthesis of Crystalline Polyester Resin 44 parts by mol of 1,9-nonanediol, 56 parts by mol of dodecane dicarboxylic acid, and 0.05 part by mol of dibutyl tin oxide are put in a three-neck flask dried by heating, nitrogen gas is then put into the container to maintain an inert gas atmosphere, and then the temperature is raised. Subsequently, a copolycondensation reaction is caused at 150° C. to 230° C. for 2 hours, and then the temperature is slowly raised to 230° C., followed by stirring for 5 hours. When becoming viscous, the resultant is air-cooled to stop the reaction, thereby synthesizing a crystalline polyester resin.

Preparation of Crystalline Polyester Resin Particle Dispersion 300 parts of the obtained crystalline polyester resin, 700 parts of deionized water, and 6 parts of sodium dodecylbenzenesulfonate are put in an emulsification tank of a high temperature high pressure emulsification device (Cavitron CD1010), followed by heating and melting at 130° C. Thereafter, the resultant is dispersed at 110° C. for 30 minutes at a flow rate of 3 L/m and 10000 rpm and passed through a cooling tank, thereby preparing a crystalline polyester resin particle dispersion having a solid content of 30% and a volume average particle size $D_{50v}$ of 125 nm.

Preparation of Release Agent Dispersion

Carnauba wax (RC-160 manufactured by Toakasei Co. Ltd.): 50 parts

Anionic surfactant (Neogen RK manufactured by Daiichi Kogyo Seiyaku Co., Ltd.): 1.0 part Deionized water: 200 parts The above components are mixed and heated at 95° C. and dispersed using a homogenizer (Ultra Turrax T50 manufactured by IKA). Thereafter, the resultant is dispersed for 360 minutes by using a Manton-Gaulin high-pressure homogenizer (manufactured by Manton-Gaulin Company), thereby preparing a release agent dispersion (solid content concentration: 20%) in which release agent particles having a volume average particle size of 0.23 μm are dispersed.

Preparation of Brilliant Pigment Dispersion 100 parts of an aluminum pigment (CR9800RM manufactured by Asahi Kasei Chemicals Corporation) is pulverized with a roll mill by using zirconia beads (1 mm). Subsequently, the aluminum pigment is classified with an Elbow Jet classifier (EJ-L3 manufactured by MATSUBO Corporation) at a cut point of 3 μm, and the resultant is washed 5 times with 400 parts of isopropyl alcohol (manufactured by Kanto Kagaku), followed by drying. Thereafter, 300 parts of water is mixed in based on 100 parts of the aluminum pigment, thereby obtaining a brilliant pigment dispersion.

Preparation of Brilliant Particles

Amorphous polyester resin particle dispersion: 168 parts

Crystalline polyester resin particle dispersion: 25 parts

Release agent dispersion: 33 parts

Brilliant pigment dispersion: 75 parts

10% aqueous nitric acid solution of polyaluminum chloride (manufactured by Taimei Chemicals Co., Ltd.): 1.7 parts The above components are put in a 3 L stainless steel reaction container in the above amounts and mixed by being dispersed with a homogenizer (Ultra Turrax T50 manufactured by TKA) at 5000 rpm for 15 minutes, thereby obtaining a raw material dispersion.

Subsequently, the raw material dispersion is transferred to a polymerization vessel including a stirring blade and a thermometer and is started to be heated with a mantle heater at a rotation frequency of stirring of 300 rpm, thereby accelerating growth of aggregated particles at 59° C. At this time, pH of the raw material dispersion is controlled within a range of from 2.2 to 3.5 by using 0.3 N nitric acid and a 1 N aqueous sodium hydroxide solution. The dispersion is held at the above pH range for about 2 hours, thereby forming aggregated particles. Thereafter, pH is increased to 8.0 so as to cause the aggregated particles to coalesce. In this manner, brilliant particles are obtained.

Preparation of Colorless Particles

Amorphous polyester resin particle dispersion (1): 23.3 parts

Crystalline polyester resin particle dispersion: 3.5 parts

Release agent dispersion: 4.6 parts

10% aqueous nitric acid solution of polyaluminum chloride (manufactured by Taimei Chemicals Co., Ltd.): 0.15 part The above components are put in a stainless steel reaction container in the above amounts and mixed by being dispersed with a homogenizer (Ultra Turrax T50 manufactured by IKA) at 5000 rpm for 15 minutes, thereby obtaining a raw material dispersion.

Subsequently, the raw material dispersion is transferred to a polymerization vessel including a stirring blade and a thermometer and is started to be heated with a mantle heater at a rotation frequency of stirring of 300 rpm, thereby accelerating growth of aggregated particles at 44° C. At this time, pH of the raw material dispersion is controlled within a range of from 2.2 to 3.5 by using 0.3 N nitric acid and a 1 N aqueous sodium hydroxide solution. The dispersion is held at the above pH range for about 2 hours, thereby forming aggregated particles. Thereafter, pH is increased to 8.0 so as to cause the aggregated particles to coalesce. In this manner, colorless particles are obtained.

Preparation of Toner Particles

The colorless particles are added to the brilliant particles under stirring, and the resultant is left to stand for 30 minutes, and the temperature is raised to 85° C. A state where the aggregated particles have coalesced is confirmed with an optical microscope, and then the pH is reduced to 6.5 while the temperature is held at 85° C. Heating is stopped 2 hours later, and the resultant is cooled by decreasing the temperature at a rate of 1.0° C./min. Subsequently, the resultant is sieved through a 45 μm mesh and repeatedly washed with water, followed by drying using a vacuum drier, thereby obtaining toner particles.

The volume average particle size of the obtained toner particles is measured in the manner described above. As a result, the volume average particle size A of the toner particles containing the brilliant pigment is measured to be 16.3 μm, and the volume average particle size B of the toner particles not containing the brilliant pigment is measured to be 6.5 μm.

The toner particles are dispersed again in deionized water and filtered repeatedly, and the resultant is washed until the electric conductivity of the filtrate becomes equal to or less than 20 μS/cm. Thereafter, the resultant is subjected to vacuum drying in an oven at 40° C. for 5 hours, thereby obtaining toner particles. The obtained toner particles are taken as toner particles 1.

Preparation of Toner Particles 2

Toner particles 2 are obtained in the same manner as in the preparation of the toner particles 1, except that the amorphous polyester resin particle dispersion (1) is used at 13.4 parts, the crystalline polyester resin particle dispersion is used at 2.0 parts, and the release agent dispersion is used at 2.6 parts for preparing the colorless particles.

In the toner particles 2, the volume average particle size A of the toner particles containing the brilliant pigment is 16.2 μm, and the volume average particle size B of the toner particles not containing the brilliant pigment is 6.3 μm.

Preparation of Toner Particles 3

Toner particles 3 are obtained in the same manner as in the preparation of the toner particles 1, except that the amorphous polyester resin particle dispersion (1) is used at 8.8 parts, the crystalline polyester resin particle dispersion is used at 1.3 parts, and the release agent dispersion is used at 1.7 parts for preparing the colorless particles.

In the toner particles 3, the volume average particle size A of the toner particles containing the brilliant pigment is 16.3 μm, and the volume average particle size B of the toner particles not containing the brilliant pigment is 6.2 μm.

Preparation of Toner Particles 4

Toner particles 4 are obtained in the same manner as in the preparation of the toner particles 1, except that the amorphous polyester resin particle dispersion (1) is used at 4.3 parts, the crystalline polyester resin particle dispersion is used at 0.6 part, and the release agent dispersion is used at 0.8 part for preparing the colorless particles.

In the toner particles 4, the volume average particle size A of the toner particles containing the brilliant pigment is 16.0 μm, and the volume average particle size B of the toner particles not containing the brilliant pigment is 6.1 μm.

Preparation of Toner Particles 5

Toner particles 5 are obtained in the same manner as in the preparation of the toner particles 1, except that the colorless particles are not prepared.

In the toner particles 5, the volume average particle size A of the toner particles containing the brilliant pigment is 16.3 μm, and the volume average particle size B of the toner particles not containing the brilliant pigment fails to be confirmed.

Preparation of Toner Particles 6

Toner particles 6 are obtained in the same manner as in the preparation of the toner particles 1, except that the amorphous polyester resin particle dispersion (1) is used at 81.7 parts, the crystalline polyester resin particle dispersion is used at 12.2 parts, and the release agent dispersion is used at 16 parts for preparing the colorless particles.

In the toner particles 6, the volume average particle size A of the toner particles containing the brilliant pigment is 16.4 μm, and the volume average particle size B of the toner particles not containing the brilliant pigment is 6.6 μm.

Preparation of Toner Particles 7

Toner particles 7 are obtained in the same manner as in the preparation of the toner particles 1, except that the amorphous polyester resin particle dispersion (1) is used at 98.8 parts, the crystalline polyester resin particle dispersion is used at 14.7 parts, and the release agent dispersion is used at 19.4 parts for preparing the colorless particles.

In the toner particles 7, the volume average particle size A of the toner particles containing the brilliant pigment is 16.5 μm, and the volume average particle size B of the toner particles not containing the brilliant pigment is 6.6 μm.

Preparation of Toner Particles 8

Toner particles 8 are obtained in the same manner as in the preparation of the toner particles 1, except that the amorphous polyester resin particle dispersion (1) is used at 134.3 parts, the crystalline polyester resin particle dispersion is used at 20.0 parts, and the release agent dispersion is used at 26.4 parts for preparing the colorless particles.

In the toner particles 8, the volume average particle size A of the toner particles containing the brilliant pigment is 16.2 μm, and the volume average particle size B of the toner particles not containing the brilliant pigment is 6.7 μm.

Preparation of Toner Particles 9

Toner particles 9 are obtained in the same manner as in the preparation of the toner particles 1, except that the amorphous polyester resin particle dispersion (1) is used at 145.9 parts, the crystalline polyester resin particle dispersion is used at 21.7 parts, and the release agent dispersion is used at 28.7 parts for preparing the colorless particles.

In the toner particles 9, the volume average particle size A of the toner particles containing the brilliant pigment is 16.3 μm, and the volume average particle size B of the toner particles not containing the brilliant pigment is 6.7 μm.

Preparation of Toner Particles 10

Toner particles 10 are obtained in the same manner as in the preparation of the toner particles 1, except that the heating temperature for preparing the brilliant particles is changed to 62° C. from 59° C., and the heating temperature for preparing the colorless particles is changed to 47° C. from 44° C.

In the toner particles 10, the volume average particle size A of the toner particles containing the brilliant pigment is 18.1 μm, and the volume average particle size B of the toner particles not containing the brilliant pigment is 9.2 μm.

Preparation of Toner Particles 11

Toner particles 11 are obtained in the same manner as in the preparation of the toner particles 1, except that the heating temperature for preparing the brilliant particles is changed to 63° C. from 59° C., and the heating temperature for preparing the colorless particles is changed to 47.6° C. from 44° C.

In the toner particles 11, the volume average particle size A of the toner particles containing the brilliant pigment is 19.1 μm, and the volume average particle size B of the toner particles not containing the brilliant pigment is 9.6 μm.

Preparation of Toner Particles 12

Toner particles 12 are obtained in the same manner as in the preparation of the toner particles 1, except that the heating temperature for preparing the brilliant particles is changed to 64° C. from 59° C., and the heating temperature for preparing the colorless particles is changed to 54° C. from 44° C.

In the toner particles 12, the volume average particle size A of the toner particles containing the brilliant pigment is 20.3 μm, and the volume average particle size B of the toner particles not containing the brilliant pigment is 12.7 μm.

Preparation of Toner Particles 13

Toner particles 13 are obtained in the same manner as in the preparation of the toner particles 1, except that the heating temperature for preparing the brilliant particles is changed to 67° C. from 59° C., and the heating temperature for preparing the colorless particles is changed to 54.5° C. from 44° C.

In the toner particles 13, the volume average particle size A of the toner particles containing the brilliant pigment is 23.2

μm, and the volume average particle size B of the toner particles not containing the brilliant pigment is 13.3 μm.

Preparation of Toner Particles 14

Toner particles 14 are obtained in the same manner as in the preparation of the toner particles 1, except that the heating temperature for preparing the brilliant particles is changed to 58° C. from 59° C., and the heating temperature for preparing the colorless particles is changed to 43° C. from 44° C.

In the toner particles 14, the volume average particle size A of the toner particles containing the brilliant pigment is 14.8 μm, and the volume average particle size B of the toner particles not containing the brilliant pigment is 5.5 μm.

Preparation of Toner Particles 15

Toner particles 15 are obtained in the same manner as in the preparation of the toner particles 1, except that the 10% aqueous nitric acid solution of polyaluminum chloride is used at 1.5 parts, and the heating temperature is changed to 58° C. from 59° C. for preparing the brilliant particles, and that the heating temperature for preparing the colorless particles is changed to 42.5° C. from 44° C.

In the toner particles 15, the volume average particle size A of the toner particles containing the brilliant pigment is 14.1 μm, and the volume average particle size B of the toner particles not containing the brilliant pigment is 5.4 μm.

Preparation of Toner Particles 16

Toner particles 16 are obtained in the same manner as in the preparation of the toner particles 1, except that the heating temperature for preparing the brilliant particles is changed to 54° C. from 59° C., and the heating temperature for preparing the colorless particles is changed to 35° C. from 44° C.

In the toner particles 16, the volume average particle size A of the toner particles containing the brilliant pigment is 13.3 μm, and the volume average particle size B of the toner particles not containing the brilliant pigment is 3.3 μm.

Preparation of Toner Particles 17

Toner particles 17 are obtained in the same manner as in the preparation of the toner particles 1, except that the 10% aqueous nitric acid solution of polyaluminum chloride is used at 1.5 parts, and the heating temperature is changed to 53° C. from 59° C. for preparing the brilliant particles, and that the 10% aqueous nitric acid solution of polyaluminum chloride is used at 0.12 part, and the heating temperature is changed to 34° C. from 44° C. for preparing the colorless particles.

In the toner particles 17, the volume average particle size A of the toner particles containing the brilliant pigment is 12.7 μm, and the volume average particle size B of the toner particles not containing the brilliant pigment is 3.2 μm.

Preparation of Toner Particles 18

Toner particles 18 are obtained in the same manner as in the preparation of the toner particles 1, except that the brilliant pigment dispersion is used at 2.1 parts for preparing the brilliant particles, and that the amorphous polyester resin particle dispersion (1) is used at 18.8 parts, the crystalline polyester resin particle dispersion is used at 2.8 parts, and the release agent dispersion is used at 3.7 parts for preparing the colorless particles.

In the toner particles 18, the volume average particle size A of the toner particles containing the brilliant pigment is 16.3 μm, and the volume average particle size B of the toner particles not containing the brilliant pigment is 6.5 μm.

Preparation of Toner Particles 19

Toner particles 19 are obtained in the same manner as in the preparation of the toner particles 1, except that the brilliant pigment dispersion is used at 3.1 parts for preparing the brilliant particles, and that the amorphous polyester resin particle dispersion (1) is used at 18.9 parts, the crystalline polyester resin particle dispersion is used at 2.8 parts, and the release agent dispersion is used at 3.7 parts for preparing the colorless particles.

In the toner particles 19, the volume average particle size A of the toner particles containing the brilliant pigment is 16.3 μm, and the volume average particle size B of the toner particles not containing the brilliant pigment is 6.5 μm.

Preparation of Toner Particles 20

Toner particles 20 are obtained in the same manner as in the preparation of the toner particles 1, except that the brilliant pigment dispersion is used at 13.0 parts for preparing the brilliant particles, and that the amorphous polyester resin particle dispersion (1) is used at 19.6 parts, the crystalline polyester resin particle dispersion is used at 2.9 parts, and the release agent dispersion is used at 3.9 parts for preparing the colorless particles.

In the toner particles 20, the volume average particle size A of the toner particles containing the brilliant pigment is 16.3 μm, and the volume average particle size B of the toner particles not containing the brilliant pigment is 6.5 μm.

Preparation of Toner Particles 21

Toner particles 21 are obtained in the same manner as in the preparation of the toner particles 1, except that the brilliant pigment dispersion is used at 13.9 parts for preparing the brilliant particles, and that the amorphous polyester resin particle dispersion (1) is used at 19.7 parts, the crystalline polyester resin particle dispersion is used at 2.9 parts, and the release agent dispersion is used at 3.9 parts for preparing the colorless particles.

In the toner particles 21, the volume average particle size A of the toner particles containing the brilliant pigment is 16.3 μm, and the volume average particle size B of the toner particles not containing the brilliant pigment is 6.5 μm.

Preparation of Toner Particles 22

Toner particles 22 are obtained in the same manner as in the preparation of the toner particles 1, except that the brilliant pigment dispersion is used at 81.5 parts for preparing the brilliant particles, and that the amorphous polyester resin particle dispersion (1) is used at 24.6 parts, the crystalline polyester resin particle dispersion is used at 3.7 parts, and the release agent dispersion is used at 4.8 parts for preparing the colorless particles.

In the toner particles 22, the volume average particle size A of the toner particles containing the brilliant pigment is 16.3 μm, and the volume average particle size B of the toner particles not containing the brilliant pigment is 6.5 μm.

Preparation of Toner Particles 23

Toner particles 23 are obtained in the same manner as in the preparation of the toner particles 1, except that the brilliant pigment dispersion is used at 90.6 parts for preparing the brilliant particles, and that the amorphous polyester resin particle dispersion (1) is used at 25.2 parts, the crystalline polyester resin particle dispersion is used at 3.8 parts, and the release agent dispersion is used at 5.0 parts for preparing the colorless particles.

In the toner particles 23, the volume average particle size A of the toner particles containing the brilliant pigment is 16.3 μm, and the volume average particle size B of the toner particles not containing the brilliant pigment is 6.5 μm.

Preparation of Toner Particles 24

Toner particles 24 are obtained in the same manner as in the preparation of the toner particles 1, except that the brilliant pigment dispersion is used at 105.4 parts for preparing the brilliant particles, and that the amorphous polyester resin particle dispersion (1) is used at 26.3 parts, the crystalline polyester resin particle dispersion is used at 3.9 parts, and the release agent dispersion is used at 5.2 parts for preparing the colorless particles.

In the toner particles 24, the volume average particle size A of the toner particles containing the brilliant pigment is 16.3 μm, and the volume average particle size B of the toner particles not containing the brilliant pigment is 6.5 μm.

Preparation of Toner Particles 25

Toner particles 25 are obtained in the same manner as in the preparation of the toner particles 1, except that the brilliant pigment dispersion is used at 121.4 parts for preparing the brilliant particles, and that the amorphous polyester resin particle dispersion (1) is used at 27.5 parts, the crystalline polyester resin particle dispersion is used at 4.1 parts, and the release agent dispersion is used at 5.4 parts for preparing the colorless particles.

In the toner particles 25, the volume average particle size A of the toner particles containing the brilliant pigment is 16.3 μm, and the volume average particle size B of the toner particles not containing the brilliant pigment is 6.5 μm.

Preparation of Toners (1) to (25)

By using a Henschel mixer, 1.5 parts of hydrophobic silica (RY50 manufactured by Nippon Aerosil Co., Ltd.) is mixed with the obtained respective toner particles 1 to 25 based on 100 parts of the respective toner particles for 2 minutes at a circumferential speed of 30 m/s. Thereafter, the mixtures are sieved by vibration sieving at a sieve pore size of 45 μm, thereby preparing the respective toners (1) to (25).

Preparation of Carrier

Preparation of Magnetic Particles A 120 parts of iron (III) oxide ($Fe_2O_3$), 2 parts of calcium oxide (CaO), and 1 part of magnesium oxide (MgO) are weighed, followed by pulverizing for 5 hours with a water system ball mill, thereby obtaining a mixture. The obtained mixture is dried with a spray dryer, followed by heating at 1,200° C. for 2 and a half hours, thereby performing temporary calcination.

The particles are dispersed in water and pulverized for 5 hours using stainless steel beads. A 2% aqueous polyvinyl alcohol solution (2% by weight) is added to the slurry, and then the flow rate of the spray dryer is adjusted to form particles having a volume average particle size of 66 μm. Subsequently, the particles are dried and held in an electric furnace at 1,150° C. and with an oxygen concentration of equal to or less than 0.05% by volume for 4 hours, thereby performing actual calcination. Thereafter, the resultant is crushed and then classified to adjust particle size. Subsequently, particles having a low magnetic force are separated using magnetic concentration, thereby obtaining magnetic particles A having a volume average particle size of 65 μm.

Preparation of Magnetic Particles B

Magnetic particles B having a volume average particle size of 42 μm are obtained in the same manner as in the preparation of the magnetic particles A, except that the flow rate of the spray dryer is adjusted to form particles having a volume average particle size of 44 μm and that the temperature of the electric furnace is set to 1,060° C. in the preparation of the magnetic particles A.

Preparation of Magnetic Particles C

Magnetic particles C having a volume average particle size of 55 μm are obtained in the same manner as in the preparation of the magnetic particles A, except that the flow rate of the spray dryer is adjusted to form particles having a volume average particle size of 56 μm and that the temperature of the electric furnace is set to 1,100° C. in the preparation of the magnetic particles A.

Preparation of Magnetic Particles D

Magnetic particles D having a volume average particle size of 75 μm are obtained in the same manner as in the preparation of the magnetic particles A, except that the flow rate of the spray dryer is adjusted to form particles having a volume average particle size of 76 μm and that the temperature of the electric furnace is set to 1,260° C. in the preparation of the magnetic particles A.

Preparation of Magnetic Particles E

Magnetic particles E having a volume average particle size of 95 μm are obtained in the same manner as in the preparation of the magnetic particles A, except that the flow rate of the spray dryer is adjusted to form particles having a volume average particle size of 95 μm and that the temperature of the electric furnace is set to 1,320° C. in the preparation of the magnetic particles A.

Preparation of Carriers A to E

A solution that is obtained by dissolving 99 parts of magnetic particles and 1 part of a styrene-methyl methacrylate copolymer (copolymerization ratio 40:60, Tg 90° C., weight average molecular weight 72,000: manufactured by Soken Chemical & Engineering Co., Ltd.) in 60 parts of toluene is added to the obtained magnetic particles A to E, followed by mixing at normal temperature for 20 minutes, and then the mixture is dried under reduced pressure by being heated at 75° C. Thereafter, the resultant is taken out and sieved through a mesh having a pore size of 75 μm so as to remove coarse particles, thereby obtaining carriers A to E. The volume average particle size of the obtained carriers A to E is identical to that of the magnetic particles.

Examples 1 to 39 and Comparative Examples 1 to 22

In the combination according to Table 1, the carrier and the toner are mixed at a ratio of carrier:toner=100 parts:8 parts by using a V-blender, thereby preparing developers of Examples 1 to 39 and Comparative Examples 1 to 22. These developers are respectively taken as Examples 1 to 39 and Comparative Examples 1 to 22.

Evaluation

By using the developers obtained in the respective examples, solid images are formed under the following conditions.

Specifically, the solid images are formed using an Apeos Port-II4300-modified machine manufactured by Fuji Xerox Co., Ltd. having a developing unit filled with the developer obtained in each example. The machine has been modified so as to operate even when the developer is contained only in a developing unit for black. The detail of the evaluation is as follows.

Evaluation of Brilliance

By using an ApeosPort-II4300-modified machine (apparatus) manufactured by Fuji Xerox Co., Ltd., a writing test is performed in which solid images are continuously written on 5000 sheets of recording media (P paper manufactured by Fuji Xerox Co., Ltd.) in a high-temperature and high-humidity environment (30° C./85% RH). After the writing test is performed on the $5000^{th}$ sheet, a 5 cm×5 cm solid image in which an amount of a toner applied is 4.5 g/cm$^2$ is formed on a sheet of recording paper (OK Topcoat+Paper manufactured by Oji paper Co., Ltd.) at a fixing temperature of 180° C. and fixing pressure of 4.0 kg/cm$^2$. From a three-dimensional goniospectrocolorimeter DDS5000 (NIPPON DENSHOKU INDUSTRIES CO., LTD.), a light beam is emitted to this solid image in a direction slanting 45° to the vertical direction of the surface of the solid image. In this manner, a lightness index L*45° that is obtained when the light is received in the vertical direction of the surface of the solid image, a lightness index L*15° that is obtained when the light is received in a direction slanting −30° to the vertical direction of the surface of the solid image, and a lightness index L*110° that is obtained when the light is received in a direction slanting −65° to the vertical direction of the surface of the solid image are measured. In addition, respective lightness indices are substituted into the following formula, thereby measuring a Flop Index value (FI).

$$\text{Formula: } FI=2.69\times(L^*15°-L^*110°)^{1.11}/(L^*45°)^{0.86}$$

The evaluation criteria are as follows.

G4: Flop Index value (FI) of equal to or greater than 12.5

G3: Flop Index value (FI) of equal to or greater than 10.0 and less than 12.5

G2: Flop Index value (FI) of equal to or greater than 5.0 and less than 10.0, practically usable level G1: Flop Index value (FI) of equal to or greater than 0 and less than 5.0

Evaluation of Fine Line Reproducibility

The developers, which have been used for the writing test in which 5000 sheets of solid images are written in a high-temperature and high-humidity environment (30° C./85% RH) so as to evaluate the brilliance, are compared to each other regarding whether there is destruction of characters by visual observation. Thereafter, the same test is performed on every 1000 sheets up to 15000 sheets in the same environment. In addition, the images are evaluated based on the smallest alphabet by using a test chart No. 1-R (1993) from The Society of Electrophotography of Japan.

The test is stopped at a stage where fine lines are destroyed or jagging in the edge portion is noticed. Moreover, developers that do not show problems at up to 15000 sheets are marked as "equal to or more than 15000", and the further evaluation is not performed. Developers that do not show problems at the stage of 5000 sheets are marked as "no problem".

The detail of the respective examples and comparative examples are listed in Tables 1 to 3.

The detail of the abbreviations in the tables is as follows.

"A" volume average particle size of a toner (toner particles) containing a brilliant pigment "B": volume average particle size of a toner (toner particles) not containing a brilliant pigment "C": volume average particle size of a carrier "Brilliant toner": a toner (toner particles) containing a brilliant pigment

TABLE 1

| | | | | | | | Brilliant toner | | | |
|---|---|---|---|---|---|---|---|---|---|---|
| | | | A | B | | | Proportion in | Pigment | Evaluation | |
| | Toner | Carrier | (μm) | (μm) | C/A | C/B | toner | amount | Brilliance | Fine line reproducibility |
| Example 1 | Toner 1 | Carrier A | 16.3 | 6.5 | 4.0 | 10.0 | 0.90 | 20% | G4 | Equal to or more than 15000 |
| Example 2 | Toner 2 | Carrier A | 16.2 | 6.3 | 4.0 | 10.3 | 0.94 | 20% | G4 | Equal to or more than 15000 |
| Example 3 | Toner 3 | Carrier A | 16.3 | 6.2 | 4.0 | 10.5 | 0.96 | 20% | G4 | 15000 |
| Example 4 | Toner 4 | Carrier A | 16.0 | 6.1 | 4.1 | 10.7 | 0.98 | 20% | G4 | 15000 |
| Example 5 | Toner 6 | Carrier A | 16.4 | 6.6 | 4.0 | 9.8 | 0.72 | 20% | G4 | Equal to or more than 15000 |
| Example 6 | Toner 7 | Carrier A | 16.5 | 6.6 | 3.9 | 9.8 | 0.68 | 20% | G4 | 15000 |
| Example 7 | Toner 8 | Carrier A | 16.2 | 6.7 | 4.0 | 9.7 | 0.61 | 20% | G4 | 15000 |
| Example 8 | Toner 9 | Carrier A | 16.3 | 6.7 | 4.0 | 9.7 | 0.59 | 20% | G4 | 14000 |
| Example 9 | Toner 10 | Carrier A | 18.1 | 9.2 | 3.6 | 7.1 | 0.90 | 20% | G4 | Equal to or more than 15000 |
| Example 10 | Toner 11 | Carrier A | 19.1 | 9.6 | 3.4 | 6.8 | 0.90 | 20% | G4 | 11000 |
| Example 11 | Toner 12 | Carrier A | 20.3 | 12.7 | 3.2 | 5.1 | 0.90 | 20% | G4 | 6000 |
| Example 12 | Toner 14 | Carrier A | 14.8 | 5.5 | 4.4 | 11.8 | 0.90 | 20% | G4 | Equal to or more than 15000 |
| Example 13 | Toner 15 | Carrier A | 14.1 | 5.4 | 4.6 | 12.0 | 0.90 | 20% | G4 | 13000 |
| Example 14 | Toner 16 | Carrier A | 13.3 | 3.3 | 4.9 | 19.7 | 0.90 | 20% | G4 | 8000 |
| Example 15 | Toner 18 | Carrier A | 16.3 | 6.5 | 4.0 | 10.0 | 0.90 | 0.8% | G2 | Equal to or more than 15000 |
| Example 16 | Toner 19 | Carrier A | 16.3 | 6.5 | 4.0 | 10.0 | 0.90 | 1.2% | G3 | Equal to or more than 15000 |
| Example 17 | Toner 20 | Carrier A | 16.3 | 6.5 | 4.0 | 10.0 | 0.90 | 4.8% | G3 | Equal to or more than 15000 |
| Example 18 | Toner 21 | Carrier A | 16.3 | 6.5 | 4.0 | 10.0 | 0.90 | 5.1% | G4 | Equal to or more than 15000 |
| Example 19 | Toner 22 | Carrier A | 16.3 | 6.5 | 4.0 | 10.0 | 0.90 | 24% | G4 | Equal to or more than 15000 |
| Example 20 | Toner 23 | Carrier A | 16.3 | 6.5 | 4.0 | 10.0 | 0.90 | 26% | G3 | Equal to or more than 15000 |

TABLE 2

| | | | | | | | Brilliant toner | | | |
|---|---|---|---|---|---|---|---|---|---|---|
| | | | A | B | | | Proportion in | Pigment | Evaluation | |
| | Toner | Carrier | (μm) | (μm) | C/A | C/B | toner | amount | Brilliance | Fine line reproducibility |
| Example 21 | Toner 24 | Carrier A | 16.3 | 6.5 | 4.0 | 10.0 | 0.90 | 29% | G3 | Equal to or more than 15000 |
| Example 22 | Toner 25 | Carrier A | 16.3 | 6.5 | 4.0 | 10.0 | 0.90 | 32% | G2 | Equal to or more than 15000 |
| Example 23 | Toner 16 | Carrier B | 13.3 | 3.3 | 3.2 | 12.7 | 0.90 | 20% | G4 | 7000 |
| Example 24 | Toner 17 | Carrier B | 12.7 | 3.2 | 3.3 | 13.1 | 0.90 | 20% | G4 | 7000 |
| Example 25 | Toner 1 | Carrier C | 16.3 | 6.5 | 3.4 | 8.5 | 0.90 | 20% | G4 | 13000 |
| Example 26 | Toner 10 | Carrier C | 18.1 | 9.2 | 3.0 | 6.0 | 0.90 | 20% | G4 | 11000 |
| Example 27 | Toner 14 | Carrier C | 14.8 | 5.5 | 3.7 | 10.0 | 0.90 | 20% | G4 | Equal to or more than 15000 |
| Example 28 | Toner 15 | Carrier C | 14.1 | 5.4 | 3.9 | 10.2 | 0.90 | 20% | G4 | Equal to or more than 15000 |
| Example 29 | Toner 16 | Carrier C | 13.3 | 3.3 | 4.1 | 16.7 | 0.90 | 20% | G4 | 11000 |
| Example 30 | Toner 17 | Carrier C | 12.7 | 3.2 | 4.3 | 17.2 | 0.90 | 20% | G4 | 11000 |
| Example 31 | Toner 1 | Carrier D | 16.3 | 6.5 | 4.5 | 11.4 | 0.90 | 20% | G4 | Equal to or more than 15000 |

TABLE 2-continued

| | Toner | Carrier | A (μm) | B (μm) | C/A | C/B | Brilliant toner: Proportion in toner | Brilliant toner: Pigment amount | Evaluation: Brilliance | Evaluation: Fine line reproducibility |
|---|---|---|---|---|---|---|---|---|---|---|
| Example 32 | Toner 10 | Carrier D | 18.1 | 9.2 | 4.1 | 8.0 | 0.90 | 20% | G4 | Equal to or more than 15000 |
| Example 33 | Toner 11 | Carrier D | 19.1 | 9.6 | 3.9 | 7.7 | 0.90 | 20% | G4 | Equal to or more than 15000 |
| Example 34 | Toner 12 | Carrier D | 20.3 | 12.7 | 3.6 | 5.8 | 0.90 | 20% | G4 | 8000 |
| Example 35 | Toner 13 | Carrier D | 23.2 | 13.3 | 3.2 | 5.6 | 0.90 | 20% | G4 | 6000 |
| Example 36 | Toner 14 | Carrier D | 14.8 | 5.5 | 5.0 | 13.5 | 0.90 | 20% | G4 | 11000 |
| Example 37 | Toner 11 | Carrier E | 19.1 | 9.6 | 4.9 | 9.8 | 0.90 | 20% | G4 | 12000 |
| Example 38 | Toner 12 | Carrier E | 20.3 | 12.7 | 4.6 | 7.4 | 0.90 | 20% | G4 | 7000 |
| Example 39 | Toner 13 | Carrier E | 23.2 | 13.3 | 4.1 | 7.1 | 0.90 | 20% | G4 | 10000 |

TABLE 3

| | Toner | Carrier | A (μm) | B (μm) | C/A | C/B | Brilliant toner: Proportion in toner | Brilliant toner: Pigment amount | Evaluation: Brilliance | Evaluation: Fine line reproducibility |
|---|---|---|---|---|---|---|---|---|---|---|
| Comparative Example 1 | Toner 5 | Carrier A | 16.3 | — | 4.0 | — | 1.00 | 20% | G4 | 5000 |
| Comparative Example 2 | Toner 13 | Carrier A | 23.2 | 13.3 | 2.8 | 4.9 | 0.90 | 20% | G4 | 5000 |
| Comparative Example 3 | Toner 17 | Carrier A | 12.7 | 3.2 | 5.1 | 20.3 | 0.90 | 20% | G4 | 5000 |
| Comparative Example 4 | Toner 1 | Carrier B | 16.3 | 6.5 | 2.6 | 6.5 | 0.90 | 20% | G4 | 5000 |
| Comparative Example 5 | Toner 10 | Carrier B | 18.1 | 9.2 | 2.3 | 4.6 | 0.90 | 20% | G4 | 5000 |
| Comparative Example 6 | Toner 11 | Carrier B | 19.1 | 9.6 | 2.2 | 4.4 | 0.90 | 20% | G4 | 5000 |
| Comparative Example 7 | Toner 12 | Carrier B | 20.3 | 12.7 | 2.1 | 3.3 | 0.90 | 20% | G4 | 5000 |
| Comparative Example 8 | Toner 13 | Carrier B | 23.2 | 13.3 | 1.8 | 3.2 | 0.90 | 20% | G4 | 5000 |
| Comparative Example 9 | Toner 14 | Carrier B | 14.8 | 5.5 | 2.8 | 7.6 | 0.90 | 20% | G4 | 5000 |
| Comparative Example 10 | Toner 15 | Carrier B | 14.1 | 5.4 | 2.98 | 7.8 | 0.90 | 20% | G4 | 5000 |
| Comparative Example 11 | Toner 11 | Carrier C | 19.1 | 9.6 | 2.9 | 5.7 | 0.90 | 20% | G4 | 5000 |
| Comparative Example 12 | Toner 12 | Carrier C | 20.3 | 12.7 | 2.7 | 4.3 | 0.90 | 20% | G4 | 5000 |
| Comparative Example 13 | Toner 13 | Carrier C | 23.2 | 13.3 | 2.4 | 4.1 | 0.90 | 20% | G4 | 5000 |
| Comparative Example 14 | Toner 15 | Carrier D | 14.1 | 5.4 | 5.2 | 13.7 | 0.90 | 20% | G4 | 5000 |
| Comparative Example 15 | Toner 16 | Carrier D | 13.3 | 3.3 | 5.6 | 22.4 | 0.90 | 20% | G4 | 5000 |
| Comparative Example 16 | Toner 17 | Carrier D | 12.7 | 3.2 | 5.8 | 23.1 | 0.90 | 20% | G4 | 5000 |
| Comparative Example 17 | Toner 1 | Carrier E | 16.3 | 6.5 | 5.8 | 14.5 | 0.90 | 20% | G4 | 5000 |
| Comparative Example 18 | Toner 10 | Carrier E | 18.1 | 9.2 | 5.2 | 10.2 | 0.90 | 20% | G4 | 5000 |
| Comparative Example 19 | Toner 14 | Carrier E | 14.8 | 5.5 | 6.4 | 17.1 | 0.90 | 20% | G4 | 5000 |
| Comparative Example 20 | Toner 15 | Carrier E | 14.1 | 5.4 | 6.7 | 17.4 | 0.90 | 20% | G4 | 5000 |
| Comparative Example 21 | Toner 16 | Carrier E | 13.3 | 3.3 | 7.1 | 28.5 | 0.90 | 20% | G4 | 5000 |
| Comparative Example 22 | Toner 17 | Carrier E | 12.7 | 3.2 | 7.4 | 29.4 | 0.90 | 20% | G4 | 5000 |

As clearly shown in Tables 1 to 3, the examples show superior fine line reproducibility while maintaining the brilliance of an image, compared to the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developer comprising a mixture including:

a first toner that contains a binder resin and a brilliant pigment;

a second toner that contains a binder resin without a brilliant pigment; and a carrier, wherein the developer satisfies the following formulae, $$5\ \mu m \leq A \leq 30\ \mu m \quad (1)$$

$$1\ \mu m \leq B \leq 15\ \mu m \quad (2)$$

$$3.0 \leq C/A \leq 5.0 \quad (3)$$

$$5.0 \leq C/B \leq 20.0, \quad (4)$$

wherein A represents a volume average particle size of the first toner, B represents a volume average particle size of the second toner, and C represents a volume average particle size of the carrier.

2. The electrostatic charge image developer according to claim 1, which satisfies the following formulae, $$10\ \mu m \leq A \leq 20\ \mu m \quad (5)$$

$$5\ \mu m \leq B \leq 10\ \mu m \quad (6)$$

$$3.5 \leq C/A \leq 4.5 \quad (7)$$

$$7.0 \leq C/B \leq 12.0. \quad (8)$$

3. The electrostatic charge image developer according to claim 1, wherein in particles of the first toner, an average equivalent circle diameter D is longer than an average maximum thickness E.

4. The electrostatic charge image developer according to claim 3, wherein in the particles of the first toner, a ratio (E/D) between the average maximum thickness E and the average equivalent circle diameter D ranges from 0.001 to 0.500.

5. The electrostatic charge image developer according to claim 3, wherein in the particles of the first toner, a ratio (E/D) between the average maximum thickness E and the average equivalent circle diameter D ranges from 0.010 to 0.200.

6. The electrostatic charge image developer according to claim 1, wherein in particles of the first toner, when a cross-section in the thickness direction of the toner is observed, the number of pigment particles in which an angle between a major axis direction in the cross-section of the toner and a major axis direction of the pigment particles ranges from −30° to +30° is equal to or more than 60% of the entire pigment particles observed.

7. The electrostatic charge image developer according to claim 1, wherein in the particles of the first toner, when a cross-section in the thickness direction of the toner is observed, the number of pigment particles in which an angle between a major axis direction in the cross-section of the toner and a major axis direction of the pigment particles ranges from −30° to +30° is equal to or more than 70% and equal to or less than 95% of the entire pigment particles observed.

8. The electrostatic charge image developer according to claim 1, wherein particles of the first toner satisfy the following formula, $$2 \leq F/G \leq 100$$

wherein F represents a reflectance at a light-receiving angle of +30° that is measured when a solid image is formed using the toner for developing an electrostatic charge image, and incident light having an angle of incidence of −45° C. is emitted to the image from a goniophotometer, and G represents a reflectance at a light-receiving angle of −30° that is measured when incident light having an angle of incidence of −45° C. is emitted to the image from the goniophotometer.

9. The electrostatic charge image developer according to claim 8, wherein the particles of the first toner satisfy the following formula, $$20 \leq F/G \leq 90.$$

10. The electrostatic charge image developer according to claim 1, wherein the proportion of particles of the second toner in the entire toner is from 5% to 80% in terms of the number of toner particles.

11. The electrostatic charge image developer according to claim 1, wherein the first toner has flake-shaped particles that have an average equivalent circle diameter D that is longer than an average maximum thickness E.

12. The electrostatic charge image developer according to claim 1, wherein the second toner is colorless.

13. A process cartridge for an image forming apparatus, comprising:

an image holding member; and a developing unit housing the electrostatic charge image developer according to claim 1 that forms a toner image by developing an electrostatic latent image formed on a surface of the image holding member.

14. The process cartridge for an image forming apparatus according to claim 13, wherein the developer satisfies the following formulae, $$10\ \mu m \leq A \leq 20\ \mu m \quad (1)$$

$$5\ \mu m \leq B \leq 10\ \mu m \quad (2)$$

$$3.5 \leq C/A \leq 4.5 \quad (3)$$

$$7.0 \leq C/B \leq 12.0. \quad (4)$$

15. An image forming apparatus comprising:

an image holding member;

a charging unit that charges a surface of the image holding member;

a latent image-forming unit that forms an electrostatic latent image on the surface of the image-holding member;

a developing unit housing the electrostatic charge image developer according to claim 1 that forms a toner image by developing the electrostatic latent image formed on the surface of the image holding member; and a transfer unit that transfers the developed toner image to a transfer medium.

16. The image forming apparatus according to claim 15, wherein the developer satisfies the following formulae, $$10\ \mu m \leq A \leq 20\ \mu m \quad (1)$$

$$5\ \mu m \leq B \leq 10\ \mu m \quad (2)$$

$$3.5 \leq C/A \leq 4.5 \quad (3)$$

$$7.0 \leq C/B \leq 12.0. \quad (4)$$

17. An image forming method, comprising:

charging a surface of the image holding member;

forming an electrostatic latent image on the surface of the image holding member;

forming a toner image by developing the electrostatic latent image formed on the surface of the image holding member by using a developer; and transferring the developed toner image to a transfer medium, wherein the developer is the electrostatic charge image developer according to claim 1.

18. The image forming method according to claim 17, wherein the developer satisfies the following formulae, $$10\ \mu m \leq A \leq 20\ \mu m \quad (1)$$

$$5\ \mu m \leq B \leq 10\ \mu m \quad (2)$$

$$3.5 \leq C/A \leq 4.5 \quad (3)$$

$$7.0 \leq C/B \leq 12.0. \quad (4)$$

* * * * *